US006789877B2

(12) United States Patent
Murakami et al.

(10) Patent No.: US 6,789,877 B2
(45) Date of Patent: Sep. 14, 2004

(54) INK-JET PRINTING HEAD AND INK-JET PRINTING APPARATUS AND METHOD

(75) Inventors: Shuichi Murakami, Kanagawa (JP); Michinari Mizutani, Kanagawa (JP); Takashi Inoue, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 58 days.

(21) Appl. No.: 10/176,034

(22) Filed: Jun. 21, 2002

(65) Prior Publication Data

US 2002/0196301 A1 Dec. 26, 2002

(30) Foreign Application Priority Data

Jun. 21, 2001 (JP) ..... 2001-188516
Aug. 10, 2001 (JP) ..... 2001-243318
Jun. 17, 2002 (JP) ..... 2002-176341

(51) Int. Cl.[7] ..... B41J 2/145
(52) U.S. Cl. ..... 347/40
(58) Field of Search ..... 347/40, 41, 42, 347/43, 20, 44, 47, 55, 54

(56) References Cited

U.S. PATENT DOCUMENTS 5,208,605 A 5/1993 Drake 6,137,502 A 10/2000 Anderson et al.

OTHER PUBLICATIONS

Patent Abstracts of Japan, vol. 009, No. 051 (M–361) (JP 59–187861, Oct. 25, 1984).

*Primary Examiner*—Raquel Yvette Gordon
(74) *Attorney, Agent, or Firm*—Fitzpatrick, Cella, Harper & Scinto

(57) ABSTRACT

The present invention provides an ink-jet printing head, and an ink-jet printing apparatus and method which enable not only larger-diameter nozzles but also smaller-diameter nozzles to be sufficiently recovered. In an ink-jet printing head according to the present invention, the number of smaller-diameter nozzles is larger than that of larger-diameter nozzles. Further, a plurality of ink channels include first ink channels in communication with the larger-diameter nozzles and second ink channels in communication with the smaller-diameter nozzles. The first ink channels and the second ink channels are mixed and arranged along an ink supply port so that a group of smaller-diameter nozzles composed of a plurality of the smaller-diameter nozzles is arranged between the lager-diameter nozzles.

20 Claims, 38 Drawing Sheets

INK-JET PRINTING HEAD AND INK-JET PRINTING APPARATUS AND METHOD

This application is based on Japanese Patent Application Nos. 2001-188516 filed Jun. 21, 2001, 2001-243318 filed Aug. 10, 2001, and 2002-176341 filed Jun. 17, 2002, the contents of which are incorporated hereinto by reference.

BACKGROUND OF THE INVENTION

1. Field of the Invention

The present invention relates to an ink-jet printing head and an ink-jet printing apparatus and method.

2. Description of the Related Art

Ink-jet printing apparatuses, which eject ink droplets from an ink-jet printing head to print an image, can print an image with various gradations by varying the size of the droplets.

A conventional ink-jet printing head, for example, the one described in U.S. Pat. No. 5,208,605, has two nozzle lines formed therein parallel with each other and extending in a direction crossing a scanning direction. One of the nozzle lines has a plurality of larger-diameter nozzles (larger-diameter ejection openings) arranged at equal intervals and through which a large ink droplets are ejected. In contrast, the other nozzle line has a plurality of smaller-diameter nozzles (smaller-diameter ejection openings) arranged at equal intervals and through which a small ink droplets are ejected.

A printing head constructed in this manner ejects ink droplets through the larger- and smaller-diameter nozzles while moving in the scanning direction, to form large and small ink dots on a printing medium.

Typically, the ink-jet printing head executes a recovery process of discharging ink that does not contributes to image printing, through the nozzles in order to maintain the appropriate ink ejection performance. The recovery process includes, for example, a suction recovery process of sucking and discharging ink through the nozzles and a pressurization recovery process of pressurizing the interior of the printing head to discharge the ink through the nozzles. Ink is supplied to each nozzle through a corresponding ink channel, and also during the recovery process, ink supplied through the respective ink channels is discharged.

However, in the above described conventional ink-jet printing head, one of the nozzle lines (larger-diameter nozzle line) has only the plurality of larger-diameter nozzles arranged therein and having a smaller ink flow resistance, whereas the other nozzle line (smaller-diameter nozzle line) has only the plurality of smaller-diameter nozzles arranged therein and having a larger ink flow resistance. Consequently, the recovery process has the following problems: If the recovery process is simultaneously executed on the plurality of larger-diameter nozzles and the plurality of smaller-diameter nozzles, a large ink flow occurs through the larger-diameter nozzle, whereas an ink flow is unlikely to occur in the smaller-diameter nozzle line. It is thus difficult to sufficiently discharge ink through the smaller-diameter nozzles. Accordingly, the ink channels that are in communication with the smaller-diameter nozzles cannot be filled with ink. As a result, the recovery process may be insufficient for the smaller-diameter nozzles. The recovery process is likely to be particularly insufficient for the smaller-diameter nozzles if the ink channels that are in communication with the plurality of larger-diameter nozzles are connected to one side of a common ink supply passage, while the ink channels that are in communication with the plurality of smaller-diameter nozzles are connected to the other side of the common ink supply passage. That is, there occurs a large difference in ink flow between the one and other sides of the common ink supply passage, further hindering ink from being discharged through the smaller-diameter nozzles.

SUMMARY OF THE INVENTION

It is an object of the present invention to provide an ink-jet printing head and an ink-jet printing apparatus and method which enable not only larger-diameter nozzles but also smaller-diameter nozzles to be sufficiently recovered.

In a first aspect of the present invention, there is provided an ink-jet printing head comprising:

a plurality of nozzles through which ink is ejected;

a plurality of ejection energy generating members provided in correspondence with the plurality of nozzles to generate ejection energy used to eject ink through the plurality of nozzles;

a plurality of ink channels which are in communication with the plurality of nozzles and which are provided with the plurality of ejection energy generating members; and an ink supply port through which ink is supplied to the plurality of ink channels, wherein the plurality of nozzles include larger-diameter nozzles and smaller-diameter nozzles, the number of smaller-diameter nozzles being larger than that of larger-diameter nozzles, the plurality of ink channels include first ink channels in communication with the larger-diameter nozzles and second ink channels in communication with the smaller-diameter nozzles, and the first ink channels and the second ink channels are mixed and arranged along the ink supply port so that a group of smaller-diameter nozzles composed of a plurality of the smaller-diameter nozzles is arranged between the lager-diameter nozzles.

In a second aspect of the present invention, there is provided an ink-jet printing method for printing on a printing medium using an ink-jet printing head of the present invention, wherein the printing medium is printed using ink droplets ejected through the larger-diameter nozzles and through the smaller-diameter nozzles.

In a third aspect of the present invention, there is provided an ink-jet printing apparatus for printing on a printing medium using an ink-jet printing head of the present invention, comprising:

movement means for the ink-jet printing head and the printing medium relatively to each other, and wherein ink droplets ejected through the larger-diameter nozzles and through the smaller-diameter nozzles are allowed to impact the printing medium.

In the ink-jet printing head according to the present invention, the number of larger-diameter nozzles is larger than that of smaller-diameter nozzles, the ink channels in communication with the larger-diameter nozzles and the ink channels in communication with the smaller-diameter nozzles are arranged with mixing each other along the ink supply port, and a group composed of plurality of smaller-diameter nozzles is arranged between the larger-diameter nozzles. Thus, during a process of discharging ink through the nozzles, a relatively large ink flow occurs which moves from the ink supply port to the larger-diameter nozzle.

Accordingly, the ink flows more easily to the plurality of smaller-diameter nozzles, located between the larger-diameter nozzles. As a result, a sufficient recovery process can be executed on the smaller-diameter nozzles too.

Further, since the number of the smaller-diameter nozzles is larger than that of the larger-diameter nozzles, more small dots can be used to print an image with a higher definition. Furthermore, the use frequency of the smaller-diameter nozzles can be distributed to improve their durability.

Moreover, by setting the arrangement of the larger- and smaller-diameter nozzles on the basis of the relationship between the ink channels and ejection speed of the droplets, an excellent recovery process can be executed on the smaller-diameter nozzles while maintaining the appropriate image printing performance. Further, a higher-quality image can be printed by combining large and small dots, formed using the larger- and smaller-diameter nozzle, in various manners depending on the arrangement of the larger- and smaller-diameter nozzles.

The above and other objects, effects, features and advantages of the present invention will become more apparent from the following description of embodiments thereof taken in conjunction with the accompanying drawings.

DETAILED DESCRIPTION OF PREFERRED EMBODIMENTS

First, basic configurations of a printing head and a printing apparatus to which the present invention is applicable will be described with reference to FIGS. 1 to 4.

Basic Configuration

Figure 1:
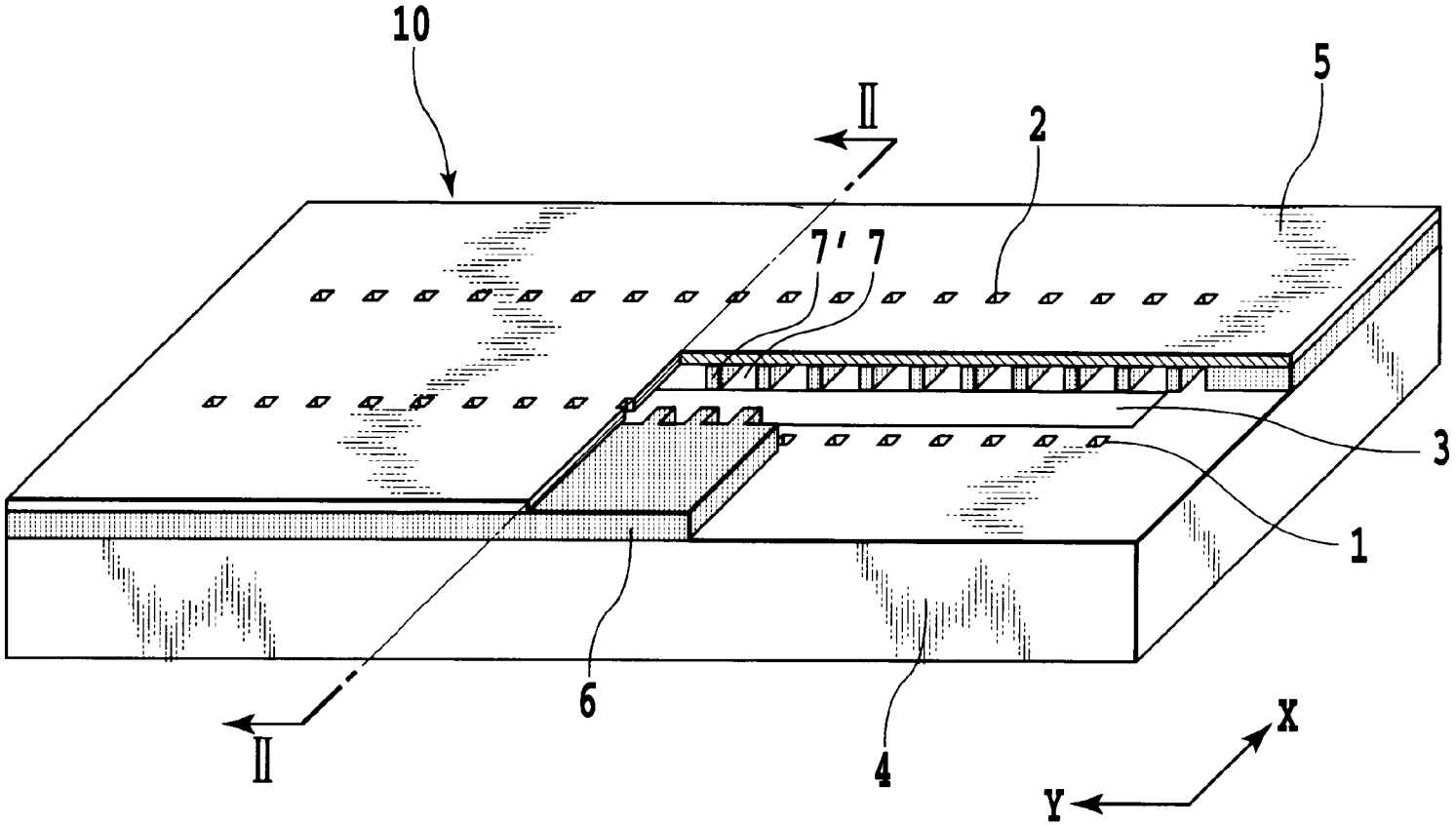
FIG. 1 is a partially cutaway perspective view of a printing head to which the present invention is applicable.
Figure 2:
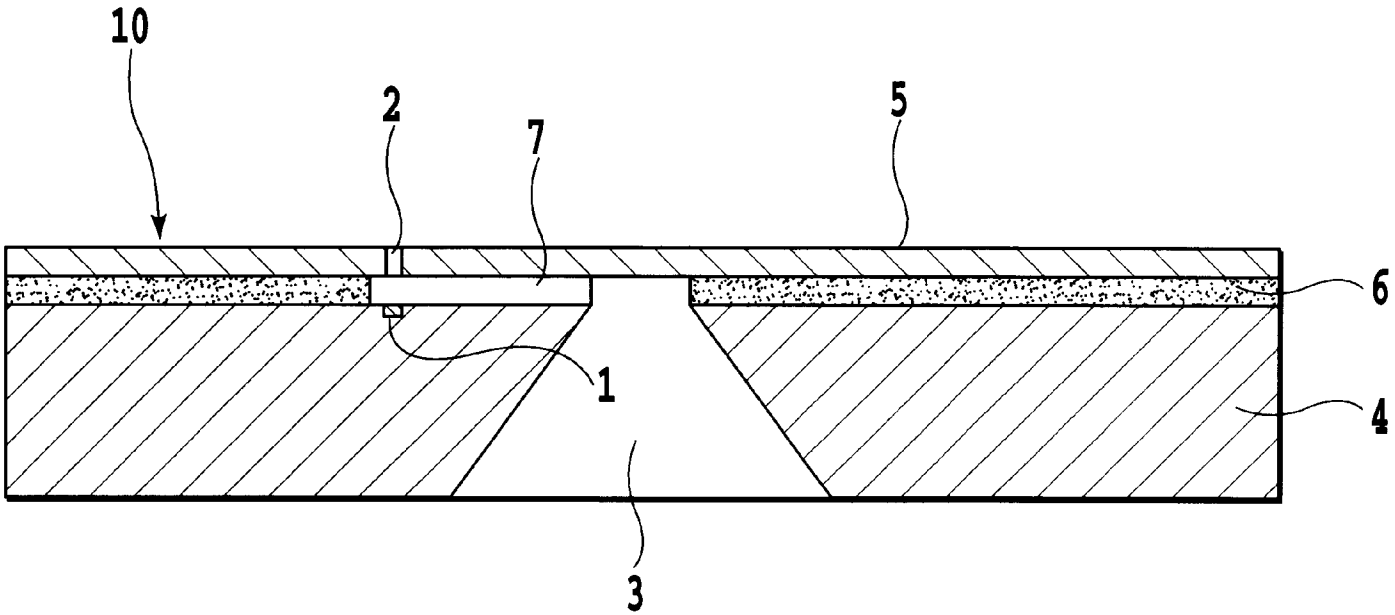
FIG. 2 is an enlarged sectional view taken along line II—II in FIG. 1.

FIG. 1 is an exploded perspective view of a printing head to which the present invention is applicable. FIG. 2 is a sectional view taken along line II—II in FIG. 1.

A printing head 10 in this example comprises a substrate 4 composed of glass, ceramics, plastic, metal, or the like. Material for the substrate 4 is arbitrary and has only to function as part of an ink channel constituting member and as a support for material layers forming thermal energy generating means, ink channels, and ink nozzles, described later. In this example, the substrate 4 is an Si substrate (wafer). The substrate 4 comprises electrothermal conversion elements 1 as thermal energy generating means, and an ink supply port 3. The electrothermal conversion elements 1 are arranged at each side of the ink supply port 3, composed of a through-slot. In FIGS. 1 and 2, electric wires and the like which are used to drive the electrothermal conversion elements 1 are not shown. The substrate 4 is provided with ink channel walls 7' that define ink channels 7. A nozzle plate 5 having nozzles (ejection port) 2 formed therein is provided on the ink channel walls 7'. The ink channel walls 7' in this example are each formed of a coating resin layer 6 different from the member constituting the nozzle plate 5. However, by forming the ink channel walls 7' on the substrate 4 using a process such as spin coating, the ink channel walls 7' and the nozzle plate 5 can be simultaneously formed using the same member.

Ink for image formation is supplied through the ink supply port 3 and introduced into the ink channels 7 formed by the ink channel walls 7'. Then, electricity is conducted through the electrothermal conversion elements 1 via wires (not shown) to cause the electrothermal conversion elements 1 to generate thermal energy. Then, the ink in the ink channels 7 is heated to generate bubbles because of film boiling. The resulting bubbling energy causes ink droplets to be ejected through the nozzles 2. The nozzles 2 are densely arranged to constitute a printing head 10 based on a multi-nozzle ink-jet method. In this example, the electrothermal conversion element 1 and the nozzle 2 are disposed opposite each other for each of the large number of ink channels 7 formed by the ink channel walls 7'.

Figure 3:
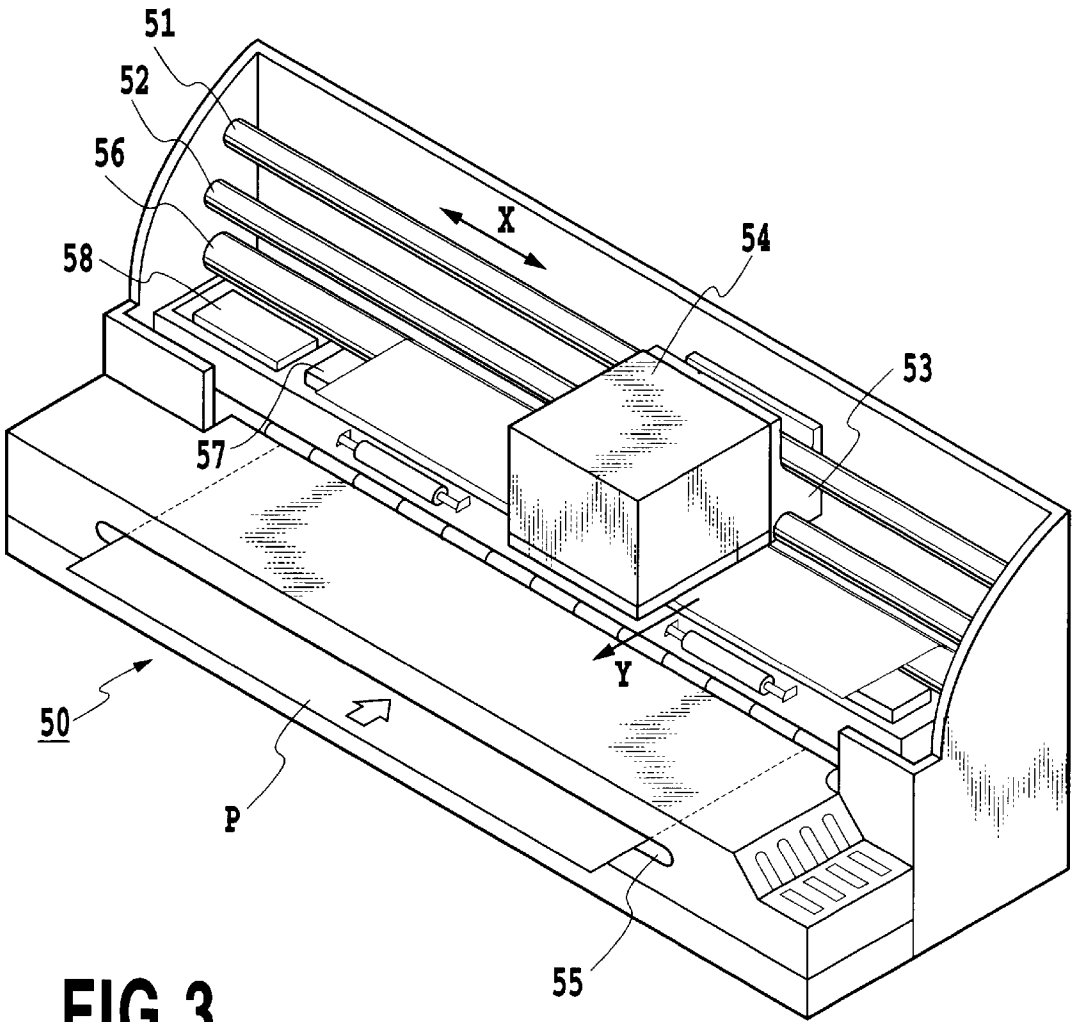
FIG. 3 is a schematic perspective view of a printing apparatus to which the present invention is applicable.

FIG. 3 is a perspective view schematically illustrating the configuration of a printing apparatus to which the present invention is applicable.

A printing apparatus 50 in this example is based on a serial scan method. Guide shafts 51 and 52 guide a carriage 53 so that the carriage 53 can be moved in a main-scanning direction, shown by arrow X. The carriage 53 is reciprocated in the main scanning direction using a carriage motor and driving force transmitting mechanisms such as belts which transmit driving force from the motor. The carriage 53 has the printing head 10 (not shown in FIG. 2) mounted thereon and ink tanks 54 also mounted thereon and from which ink is supplied to the printing head 10. The printing head 10 and the ink tanks 54 may constitute an ink-jet cartridge. A sheet P as a printing medium is inserted through an insertion port 55 formed at a front end of the apparatus, subsequently has its transportation direction reversed, and is then transported by a feed roller 56 in a sub-scanning direction shown by arrow Y. The printing apparatus 50 sequentially prints an image on the sheet P by repeating a printing operation and a transportation operation. In the printing operation, ink is ejected to a print area of the sheet P on a platen 5 while moving the printing head 10 in the main-scanning direction. In the transportation operation, the sheet P is transported in the sub-scanning direction a distance corresponding to the print width of the sheet P.

In FIG. 3, a recovery unit (recovery process means) 58 is located at the left end in a moving area of the carriage 53. The recovery unit is opposite to a surface, in which the nozzles 2 are formed, of the printing head 10 mounted on the carriage 53. The recovery unit 58 comprises a cap that can cap the nozzles 2 of the printing head 10, a suction pump that can introduce negative pressure into the cap, and others. The recovery unit 58 executes a recovery process (also referred to as a "suction recovery process") for introducing negative pressure into the cap, covering the nozzles 2, to suck and discharge ink through the nozzles 2 in order to maintain the appropriate ink ejection state of the printing head 10. Alternatively, in order to maintain the appropriate ink ejection state of the printing head 10, the recovery process (also referred to as the "ejection recovery process") may be executed by ejecting ink that does not contribute to image formation, through the nozzles 2 toward the cap.

Figure 4:
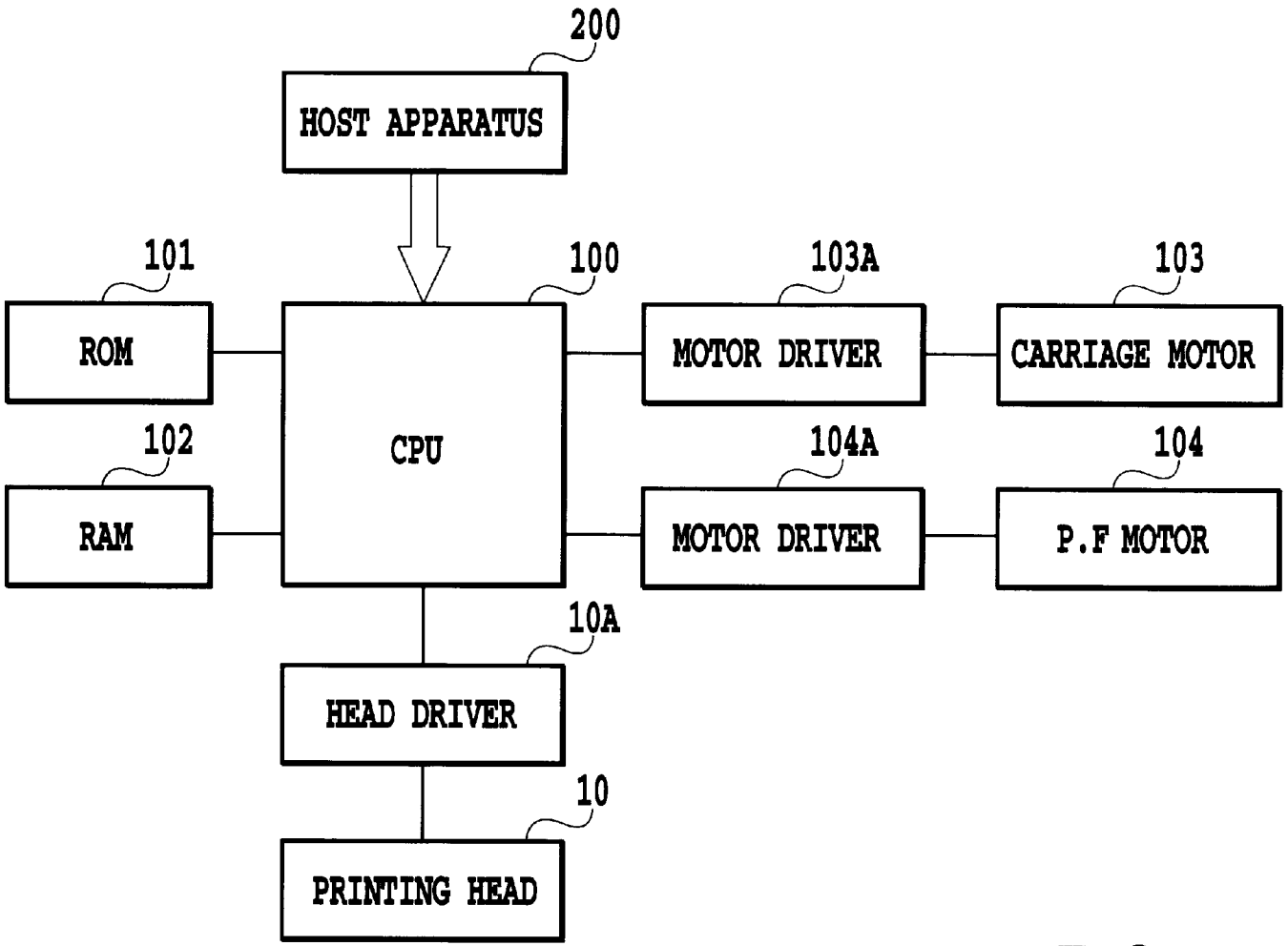
FIG. 4 is a block diagram of a control system of the printing apparatus in FIG. 3.

FIG. 4 is a schematic block diagram of a control system of a printing apparatus to which the present invention is applicable.

In FIG. 4, a CPU 100 executes processes of controlling operations of the present printing apparatus, data processing, and others. A ROM 101 stores programs for these process procedures and others, and a RAM 102 is used as a work area or the like to execute these processes. A head driver 10A is supplied driving data (image data) for the electrothermal conversion elements 1 and driving control signals (heat pulse signals) by the CPU 100, thereby, ink is ejected from the printing head 10. The CPU 100 controls, via a motor driver 103A, a carriage motor 103 for driving the carriage 53 in the main-scanning direction, and controls, via a motor driver 104A, a P.F motor 104 for transporting the sheet P in the sub-scanning direction.

First Embodiment

Figure 5:
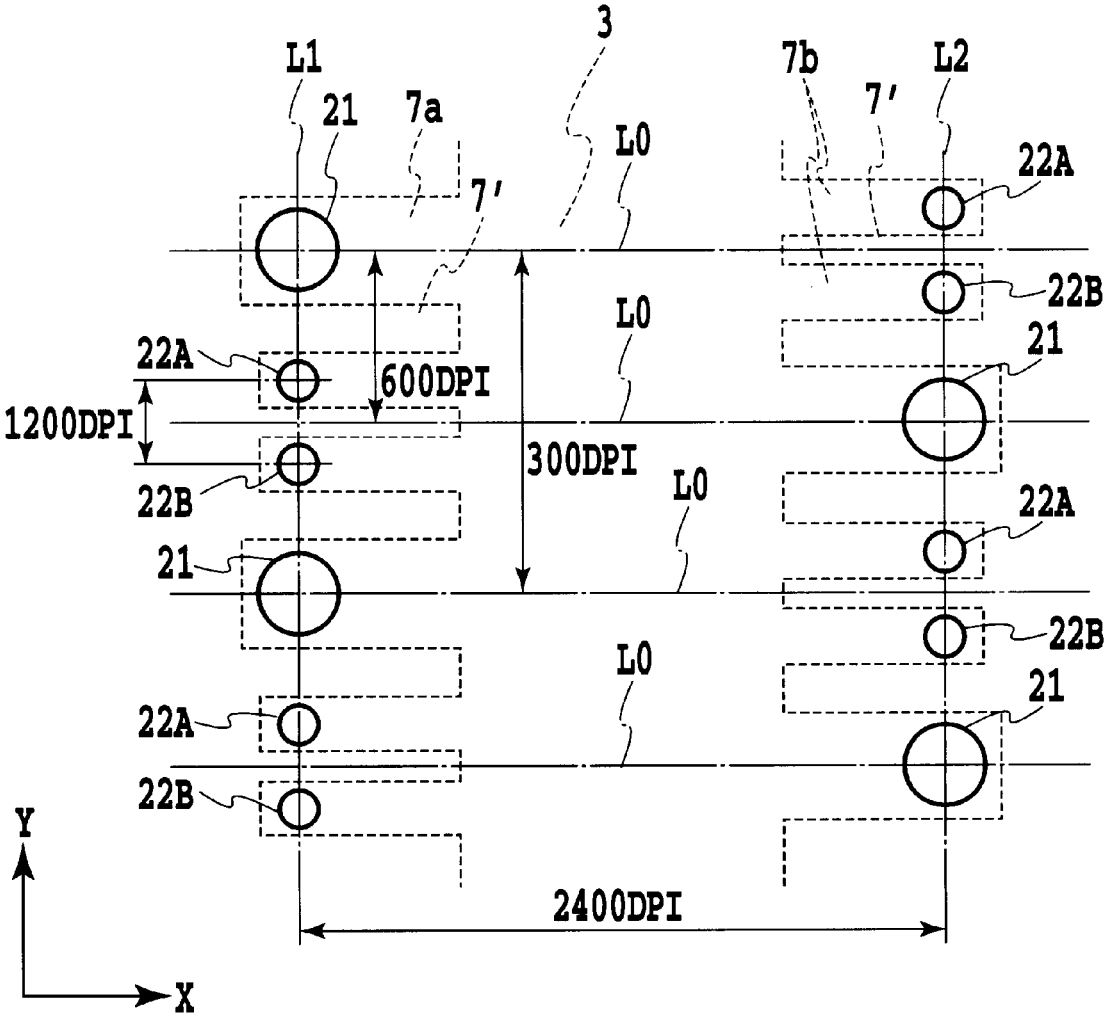
FIG. 5 is a plan view showing an essential part of a printing head according to a first embodiment of the present invention.

FIG. 5 is a plan view of an essential part of a printing head according to a first embodiment of the present invention.

A plurality of ink channels 7*a* in communication with a plurality of larger-diameter nozzles (larger-diameter ejection openings) 21 and a plurality of ink channels 7*b* in communication with a plurality of smaller-diameter nozzles (smaller-diameter ejection openings) 22 are arranged with mixing. The plurality of larger- and smaller-diameter 21 and 22 are formed on rows L1 and L2 so that a group of smaller-diameter nozzles composed of the plurality of smaller-diameter nozzles 22 is arranged between the larger-diameter nozzles 21. The group of smaller-diameter nozzles are composed of two smaller-diameter nozzles 22 (22A, 22B), as described later. The number of smaller-diameter nozzles 22 is larger than that of larger-diameter nozzles 21. The distance between two larger-diameter nozzles 21 corresponds to a resolution of 300 DPI (Dot Per Inch). The distance between two smaller-diameter nozzles 22 of the group of smaller-diameter nozzles corresponds to a resolution of 1200 DPI. Further, the pitch between the center of the larger-diameter nozzle 21 and the point located midway between the two smaller-diameter nozzles 22 (22A and 22B) corresponds to a resolution of 600 DPI. The plurality of larger-diameter nozzles 21 are arranged in a staggered pattern on the rows L1 and L2 in the arranging direction of the ink channel. Therefore, the plurality of larger-diameter nozzles 21 are arranged at equal intervals corresponding a resolution of 600 DPI as a whole. Likewise, the plurality of smaller-diameter nozzles 22 are arranged at equal intervals corresponding a resolution of 1200 DPI as a whole. Furthermore, an intermediate site (barycenter) between the adjacent smaller-diameter nozzles 22 (22A and 22B) is located on a centerline L0 passing through the center of the larger-diameter nozzle 21 and along the main-scanning direction of the printing head 10. In FIG. 5, the smaller-diameter nozzle 22 located at the (+Y) side of the centerline L0, i.e. on the upper side in FIG. 5, is defined as 22A. The smaller-diameter nozzle 22 located at the (−Y) side of the centerline L0, i.e. on the lower side in FIG. 5, is defined as 22B. The rows L1 and L2 deviate from each other by a pitch of 2400 DPI, i.e. half the resolution (1200 DPI) of the smaller-diameter nozzles 22. In this embodiment, the rows L1 and L2 deviate from each other by 10.7 $\mu$m. The printing head 10 carries out reciprocating printing while moving at a speed of 20 inch/sec in the main-scanning direction along the direction of the arrow X.

The printing head 10 has ink channels 7*a* and 7*b* formed by the ink channel walls 7'. The ink channels 7*a* correspond to the larger-diameter nozzles and the ink channels 7*b* correspond to the smaller-diameter nozzles. Further, each of the ink channels 7*a* and 7*b* is provided with an electrothermal conversion element 1 arranged opposite a corresponding one of the larger-diameter nozzles 21 and a corresponding one of the smaller-diameter nozzles 22. Furthermore, the ink channels 7*a* and 7*b* are in communication with a common ink supply port 3 through which ink is supplied to the ink channels 7*a* and 7*b*. In this embodiment, the volume of ink ejected through the larger-diameter nozzle 21 is 10 pl (pico liter). The larger-diameter nozzle 21 has a diameter of 23 μm, and the opposite electrothermal conversion element 1 has a size of 30×30 μm. On the other hand, the volume of ink ejected through the smaller-diameter nozzle 22 is 2 pl. The smaller-diameter nozzle 22 has a diameter of 11 μm. Channel height is 14 μm, and nozzle plate thickness is 11 μm.

Figure 6:
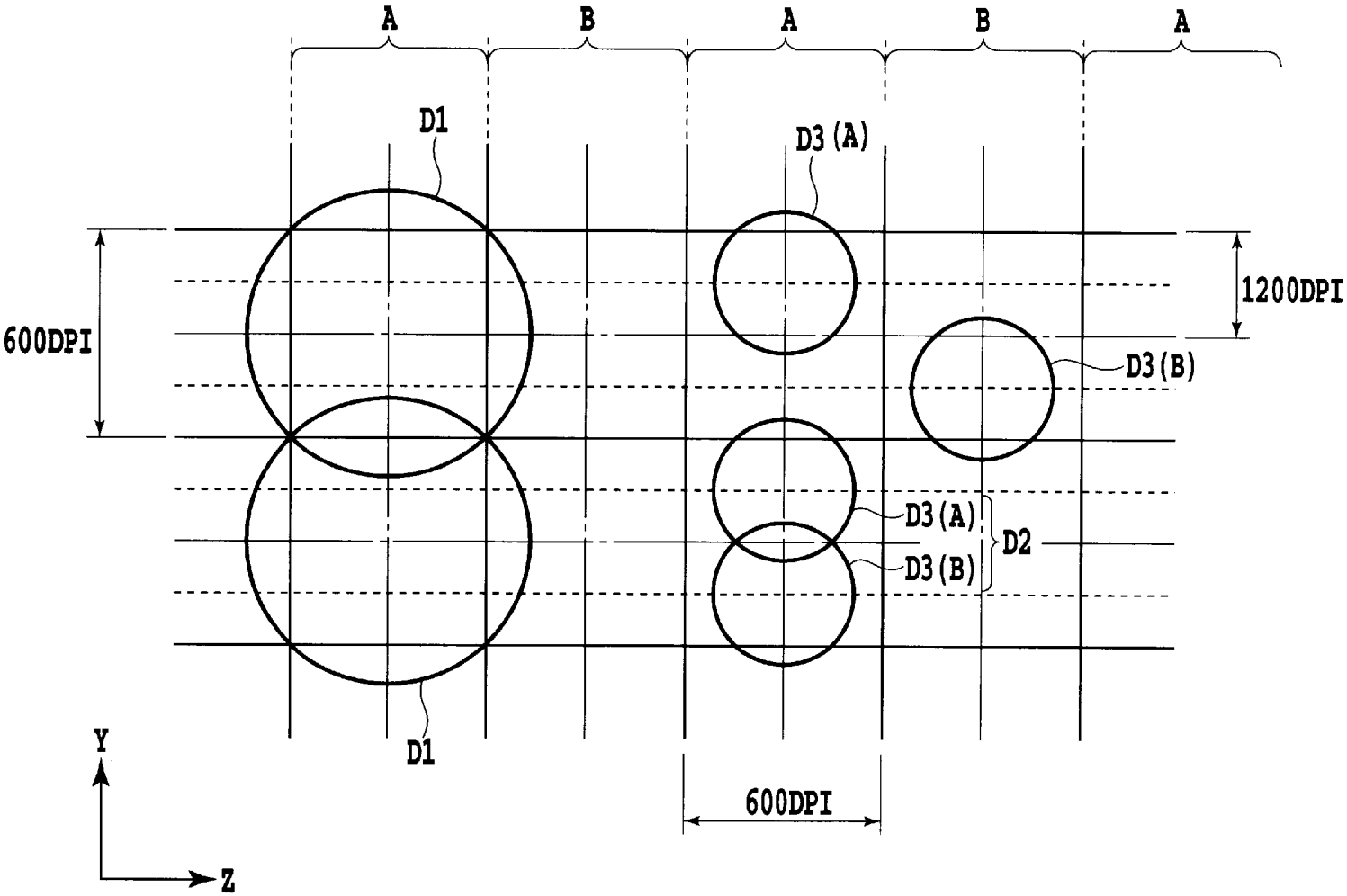
FIG. 6 is a diagram illustrating dots formed using the printing head shown in FIG. 5.

FIG. 6 is a diagram illustrating the arrangement of ink dots formed on a sheet P as a printing medium using the printing head 10.

An ink droplet ejected through the larger-diameter nozzle 21 forms a large dot D1 in a unit print range 600 ×600 DPI on the sheet P. Further, an ink droplet ejected through the smaller-diameter nozzle 22 forms a small dot D3. In FIG. 6, a small dot D3(A) is formed by an ink droplet ejected through the smaller-diameter nozzle 22A. Further, a small dot D3(B) is formed by an ink droplet ejected through the smaller-diameter nozzle 22B. Furthermore, the ink droplets ejected through the two smaller-diameter nozzles 22A and 22B form a middle-sized dot D2. That is, as shown in FIG. 6, the two small dots D3(A) and D3(B) form the middle-sized dot D2.

When the smaller-diameter nozzles 21 thus deviate from the larger-diameter nozzles 22 by 2400 DPI in the main-scanning direction, a middle-sized dot D2 can be formed within the 600×600 DPI print range. In this case, a printing operation can be performed by setting the main scanning speed of the printing head 10 at 20 inch/sec and ejecting ink through each of the larger- and smaller-diameter nozzles 21 and 22 at a driving frequency of 12 kHz. This eliminates the need to increase the driving frequency for the smaller-diameter nozzles 22 even when the middle-sized dot D2 is to be formed. Further, only two smaller-diameter nozzles 22 are required to form one middle-sized dots D2. Therefore, the smaller-diameter nozzles 22 become as durable as the larger-diameter nozzles 21.

Figure 7:
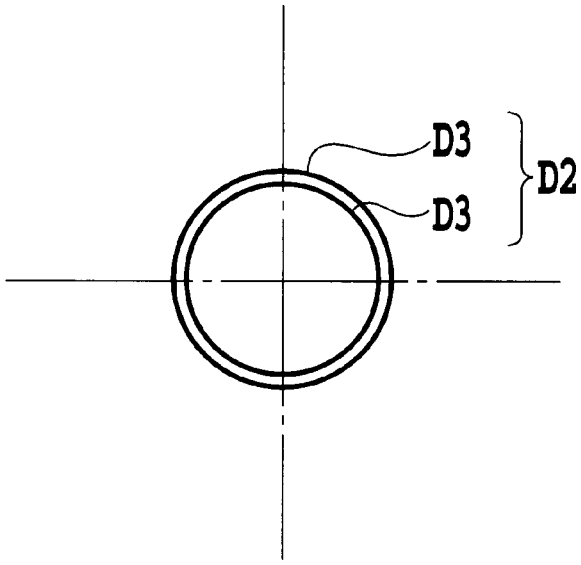
FIG. 7 is a diagram illustrating a middle-sized dot formed so as to overlap small dots, using a conventional printing head.

Furthermore, two smaller-diameter nozzles 22A and 22B located adjacent to each other in the sub-scanning direction shown by the arrow Y can be used to form a middle-sized dot D2 using two small dots D3(A) and D3(B) deviating from each other, as shown in FIG. 6. Thus, a large middle-sized dot D2 can be formed compared to a conventional example in which the conventional printing head is used to place a small dot D3 on another small dot D3 to form a middle-sized dot D2, as shown in FIG. 7. A large middle-sized dot D2 can thus be formed, thereby allowing ink to be reliably fixed to a surface layer of the sheet P. Further, dot area can be efficiently increased relative to the amount of ejected ink. Furthermore, even if there is a difference in amount of ejected ink between the smaller-diameter nozzles 22A and 22B because of a manufacture variation in nozzle area, the variation in amount of ejected ink between the nozzles can be reduced to allow the formation of a middle-sized dot with a stable dot area because the two nozzles are used to form the middle-sized dot.

The printing head 10 is filled with ink from an ink storage section including ink tanks 54 and others, through a filling operation based on ink suction or pressurization carried out by the ink-jet printing apparatus. The ink from the ink supply port 3 is filled into the nozzles 21 and 22 via the ink channels 7*a* and 7*b*. When in each of the rows L1 and L2, two smaller-diameter nozzles 22 are arranged between larger-diameter nozzles 21, as in this example, ink has an equal viscous resistance in both nozzle lines L1 and L2. Accordingly, in this embodiment, through the filling operation based on ink suction or pressurization carried out by the ink-jet printing apparatus, the nozzles 21 and 22 can be reliably filled with ink without causing bubbles to remain in the ink supply port 3 or the like. Further, instead of the ink supply form in which ink is supplied through the ink supply port 3, formed in the center of the substrate 4, as shown in FIGS. 1 and 2, described previously, ink may be supplied from two locations, i.e. the opposite ends of the substrate 4. Both supply forms produce similar effects.

By the way, the conventional printing head, as described in U.S. Pat. No. 5,208,605, has a nozzle line (larger-diameter nozzle line) with a plurality of larger-diameter nozzles and a nozzle line (smaller-diameter nozzle line) with a plurality of smaller-diameter nozzles independently, as described above. A resolution of the smaller-diameter nozzle line is higher than that of the larger-diameter nozzle line, whereby the electricity consumption during printing of the smaller-diameter nozzle line is higher than that of the larger-diameter nozzle line. As a result, the temperature on the side of the smaller-diameter nozzle line on the substrate is higher than that on the side of the larger-diameter nozzle line on the substrate, whereby a density fluctuation is caused on the printed image. Further, since the electrothermal conversion elements corresponding to the smaller-diameter nozzles have a high arrangement density, diffusion of heat by radiation from the electrothermal conversion elements is difficult to achieve. Therefore, when the conventional printing head is continuously driven at high frequency, the temperature in the vicinity of the electrothermal conversion elements corresponding to the smaller-diameter nozzles gradually increases, such that ink droplets cannot be ejected stably though the smaller-diameter nozzles.

In contrast, in the printing head in this embodiment of the invention, the plurality of ink channels 7*a* in communication with a plurality of larger-diameter nozzles 21 and the plurality of ink channels 7*b* in communication with a plurality of smaller-diameter nozzles 22 are arranged with mixing. And then, the plurality of larger- and smaller-diameter nozzles 21 and 22 are formed on rows L1 and L2 so that a group of smaller-diameter nozzles composed of the plurality of smaller-diameter nozzles 22 is arranged between a pair of the larger-diameter nozzles 21. Therefore, the electrothermal conversion elements 1 corresponding to the nozzles 21 and 22 are decentralized, such that uneven temperature distribution is unlikely to occur. In the printing head in this embodiment, a density fluctuation is unlikely to occur, and ink droplets can be ejected stably when the printing head is continuously driven at high frequency.

Further, if printing is performed using the conventional printing head by ink droplets ejected through only larger-diameter nozzles, when a plurality of ink ejection energy generating means is employed, fluid crosstalk occurs between ink channels in communication with the larger-diameter nozzles. That is, when ink droplets are ejected through the larger-diameter nozzles, ink flows through the ink channels toward the ink supply port, and then the ink flow reaches into the adjacent ink channels. Therefore, ink meniscuses in the adjacent ink channels are vibrated, thus causing density fluctuation due to differences in the volume of ejected ink. Moreover, the ink ejection directions differ from each other due to differences in the speed of the ejected ink and wetness of the face on which the nozzles are formed, caused by ink leaked from the nozzles.

In contrast, in this embodiment of the invention, an ink flow upstream in the larger-diameter nozzles (i.e., toward the ink supply port) is absorbed by the smaller-diameter nozzles located between otherwise adjacent larger-diameter nozzles. Therefore, fluid crosstalk between the ink channels in communication with larger-diameter nozzles can be hindered. In particular, in this embodiment, pairs of smaller-diameter nozzles are arranged between the larger-diameter nozzles so that pairs of smaller-diameter nozzles correspond to single larger-diameter nozzles, respectively. Therefore, the fluid crosstalk can be hindered effectively.

Further, in this embodiment of the present invention, as shown in FIG. 5, a distance between centers of the ink channels 7*a* and 7*b* adjacent to each other in the Y direction (sub-scanning direction) is longer than a distance between centers of the ink channels 7*b* adjacent to each other in the Y direction. The ink channels 7*a* are in communication with the larger-diameter nozzles 21 and the ink channels 7*b* are in communication with the smaller-diameter nozzles 22. Therefore, when printing is performed by the ink droplets ejected through both the larger- and smaller-diameter nozzles 21 and 22, fluid crosstalk from the ink channels 7*a* (in communication with the larger-diameter nozzles 21) to the ink channels 7*b* (in communication with the smaller-diameter nozzles) can be hindered. Thereby, ink droplets can be ejected stably through the smaller-diameter nozzles 22, which would otherwise be strongly influenced by the fluid crosstalk from the ink channels 7*a* in communication with the larger-diameter nozzles 21 when the printing head is driven at high frequency, on account of the small amounts of ink ejected by the smaller-diameter nozzles 22. As a result, high gradation images can be printed at high speed.

Second Embodiment

Figure 8:
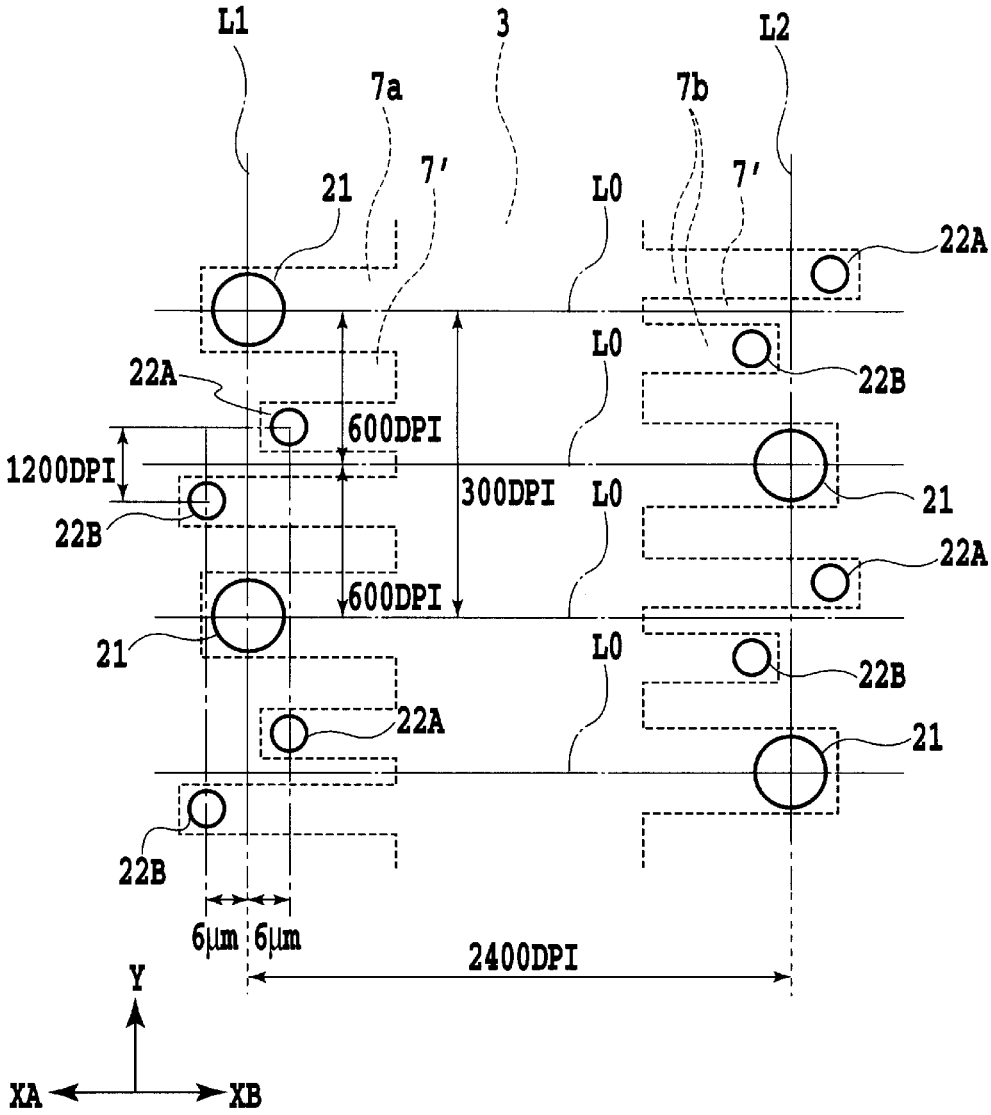
FIG. 8 is a plan view showing an essential part of a printing head according to a second embodiment of the present invention.

FIG. 8 is a plan view of an essential part of the printing head 10, illustrating a second embodiment of the present invention.

Also in this embodiment, the plurality of ink channels 7*a* in communication with the plurality of larger-diameter nozzles 21 and the plurality of ink channels 7*b* in communication with a plurality of smaller-diameter nozzles 22 are arranged with mixing, and moreover, the plurality of larger- and smaller-diameter 21 and 22 are formed on rows L1 and L2 so that a group of smaller-diameter nozzles composed of the plurality of smaller-diameter nozzles 22 arranged between the larger-diameter nozzles 21. Accordingly, as in the first embodiment, not only the larger-diameter nozzles 21 but also the smaller-diameter nozzles 22 can be appropriately recovered. Furthermore, in this embodiment, the smaller-diameter nozzles 22 are arranged so as to deviate from the lines L1 and L2, thereby preventing the formed position of the large dot D1 from deviating from the formed position of the small dot D3 during reciprocating printing.

In this embodiment, the larger-diameter nozzles 21 are formed on each of the lines L1 and L2 at equal intervals. The smaller-diameter nozzles 22 (22A and 22B) are formed at each side of each of the lines L1 and L2. In each of the lines L1 and L2, the distance between two larger-diameter nozzles 21 corresponds to a resolution of 300 DPI, and the distance between the smaller-diameter nozzles 22A and 22B corresponds to a resolution of 1200 DPI. The pitch between the center of the larger-diameter nozzle 21 and the point located midway between the smaller-diameter nozzles 22A and 22B corresponds to a resolution of 600 DPI. The larger-diameter nozzles 21 formed on the line L1 and the larger-diameter nozzles formed on the line L2 are positioned in a staggered pattern in the extending direction of the lines L1 and L2. Therefore, these larger-diameter nozzles 21 are positioned so that these are interpolated each other in the extending direction of the lines L1 and L2. Therefore, the plurality of larger-diameter nozzles 21 are arranged at equal intervals corresponding a resolution of 600 DPI as a whole. Likewise, the plurality of smaller-diameter nozzles 22 are arranged at equal intervals corresponding a resolution of 1200 DPI as a whole. In the mutual relation between the lines L1 and L2, the center of the larger-diameter nozzle 21 on one line and an intermediate site between the smaller-diameter nozzles 22A and 22B at the other line are located on the centerline L0. The ink-jet printing head 10 in this example carries out reciprocating printing while moving at a speed of 20 inch/sec in the main-scanning direction along the direction of the arrow X(XA and XB). The distance between the nozzles 21 and 22 (22A and 22B) and the sheet P as a printing medium is 1.5 mm. The volume of ink ejected through the larger-diameter nozzle 21 is 10 pl. The volume of ink ejected through the smaller-diameter nozzle 22 (22A or 22B) is 2 pl.

With the printing head 10 of this embodiment, ink dots can be formed on the sheet P as a printing medium, just as in FIG. 6 described above.

Figure 9A:
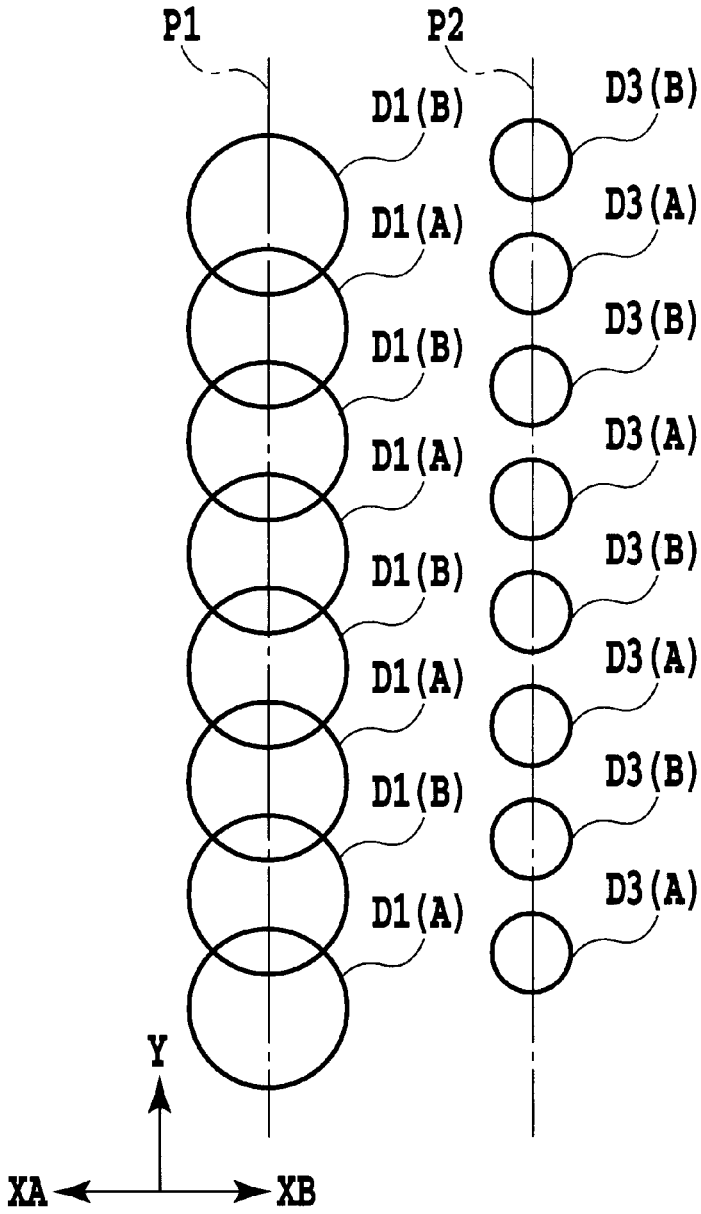
FIGS. 9A, 9B and 9C are diagrams illustrating dots formed using the printing head shown in FIG. 8.
Figure 9B:
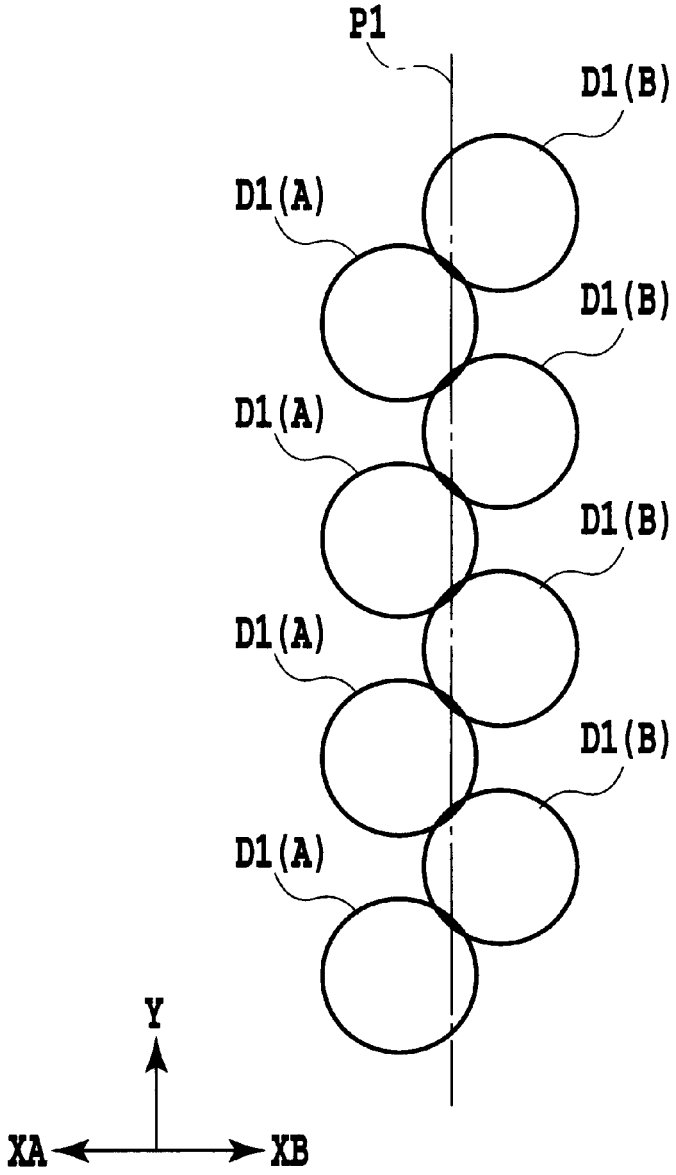

A reciprocating printing operation comprises a repetition of a forward printing operation of moving the printing head 10 in the direction of the arrow XA and a backward printing operation of moving the printing head 10 in the direction of the arrow XB. In such reciprocating printing, given that ink is ejected through the larger-diameter nozzles 21 with the same driving timing, large dots D1(A) formed by ink ejected by the printing head 10 moving in the direction of the arrow XA deviate in the direction of the arrow XA from a target print position P1 as shown in FIG. 9B. Further, large dots D1(B) formed by ink ejected by the printing head 10 moving in the direction of the arrow XB deviate in the direction of the arrow XB from the target print position P1. Typically, to correct such deviations, the driving timing with which ink is ejected is advanced during the forward printing. On the other hand, the driving timing with which ink is ejected is delayed during the backward printing.

Figure 9C:
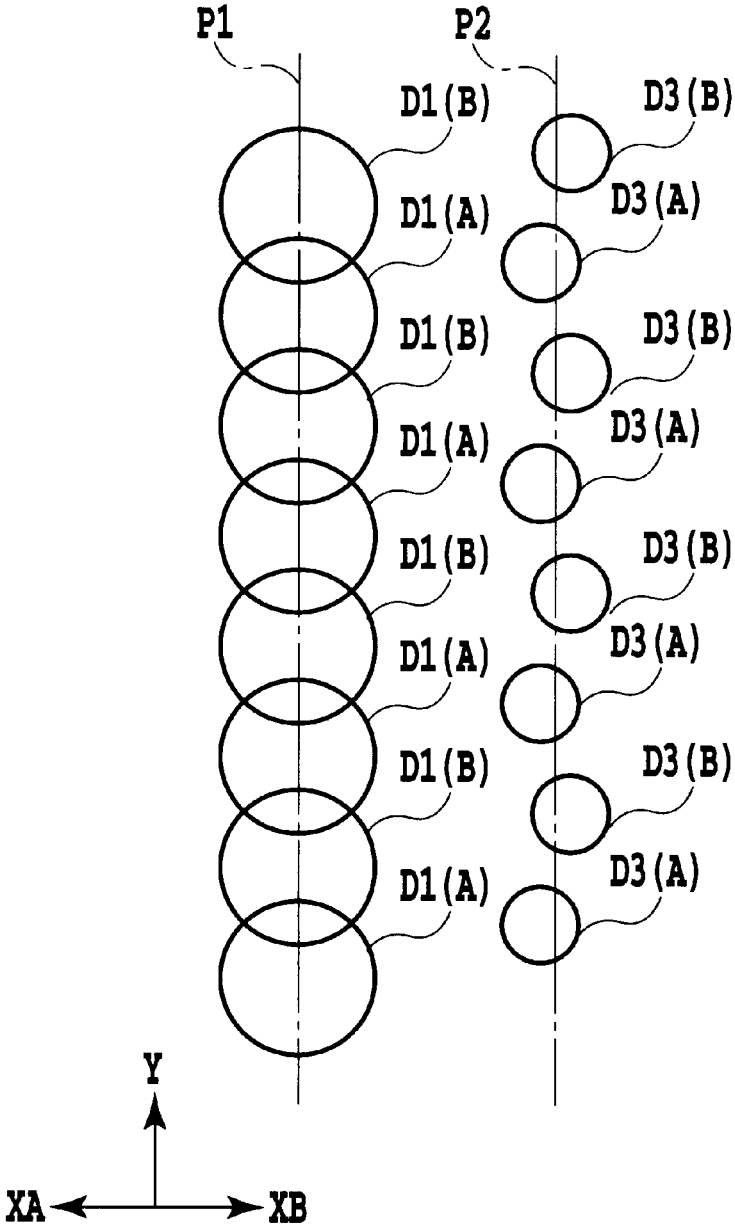

However, in this embodiment, the speed at which ink droplets forming large dots are ejected differs from the speed at which ink droplets forming small dots are ejected. Specifically, in this example, 10 pl of ink droplets forming large dots are ejected at a speed of 15 m/sec. On the other hand, 1 pl of ink droplets forming small dots are ejected at a speed of 17 m/sec. In this case, the amounts of deviations of the positions at which large and small dots are formed differ between the forward printing and the backward printing. For example, if compared to the printing head constructed as shown in FIG. 8, the printing head has both larger-diameter nozzles 21 and smaller-diameter nozzles 22 formed on each of the lines L1 and L2 in FIG. 8, the driving timing for the printing head can be adjusted to correct the positions of the large dots D1(A) and D1(B) formed during forward and backward printing. This eliminates the deviations of the formed positions. However, in this case, as shown in FIG. 9C, small dots D3(A) formed by ink ejected from the printing head moving in the direction of the arrow XA during forward printing deviate 6 $\mu$m from a target print position P2 in the direction of the arrow XA. Further, small dots D3(B) formed by ink ejected from the printing head moving in the direction of the arrow XB during backward printing deviate 6 $\mu$m from the target print position P2 in the direction of the arrow XB.

Thus, in this embodiment, the smaller-diameter nozzles 22A and 22B are arranged so as to prevent the deviation of the formed positions of the small dots D3(A) and D3(B). That is, in each of the lines L1 and L2, the smaller-diameter nozzles 22A are arranged so as to deviate 6 μm from the lines L1 and L2 in the direction of the arrow XB, and moreover, the smaller-diameter nozzles 22B are arranged so as to deviate 6 μm from the lines L1 and L2 in the direction of the arrow XA. Then, reciprocating printing is carried out by using the smaller-diameter nozzles 22A in each of the lines L1 and L2 for forward printing, while using the smaller-diameter nozzles 22B in each of the lines L1 and L2 for backward printing. This prevents both large dots D1 and small dots D3 from deviating during reciprocating printing as shown in FIG. 9A.

Further, in this embodiment, the printing head 10 has a main-scanning speed of 20 inch/sec, so that during a printing operation, the driving frequency for ink ejection is 12 kHz regardless of whether ink is ejected through the larger-diameter nozzles 21 or the smaller-diameter nozzles 22 (22A and 22B). This eliminates the need to increase the driving frequency for ejection of ink through the smaller-diameter nozzles 22 even when a middle-sized dot D2 is to be formed. Furthermore, during a wiping operation performed by the ink-jet printing apparatus, ink scraped from the larger-diameter nozzles 21 is prevented from approaching and affecting the smaller-diameter nozzles 22. Therefore, appropriate printing can be achieved while preventing a failure to eject ink or a decrease in amount of ink ejected.

Third Embodiment

Figure 10:
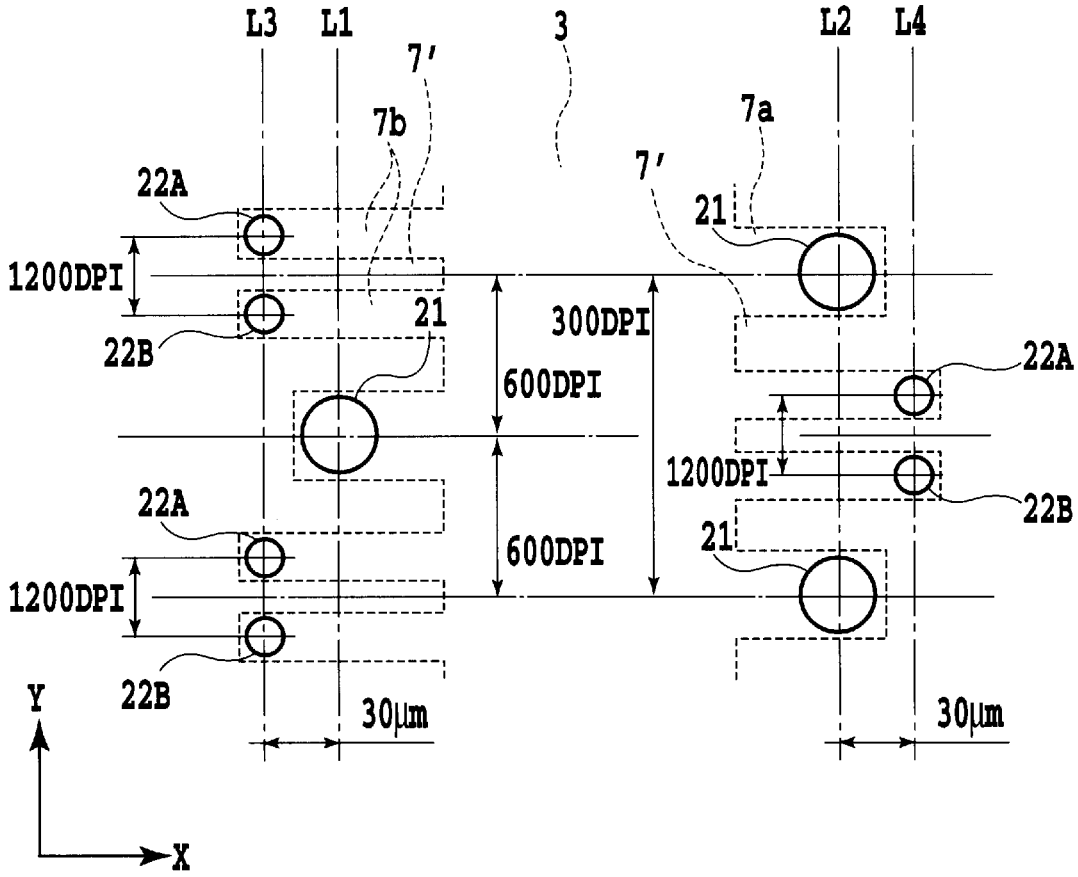
FIG. 10 is a plan view showing an essential part of a printing head according to a third embodiment of the present invention.

FIG. 10 is a plan view of an essential part of the printing head 10, illustrating a third embodiment of the present invention.

Also in this embodiment, the plurality of ink channels 7*a* in communication with the plurality of larger-diameter nozzles 21 and the plurality of ink channels 7*b* in communication with a plurality of smaller-diameter nozzles 22 are arranged with mixing, and moreover, the plurality of larger- and smaller-diameter 21 and 22 are formed on rows L1 and L2 so that a group of smaller-diameter nozzles composed of the plurality of smaller-diameter nozzles 22 is arranged between the larger-diameter nozzles 21. Accordingly, as in the first embodiment described previously, not only the larger-diameter nozzles 21 but also the smaller-diameter nozzles 22 can be appropriately recovered. Furthermore, in this embodiment, the larger-diameter nozzles 21 deviate from the smaller-diameter nozzles 22 so as to avoid locating both types of nozzles on the same line. Consequently, as in the second embodiment described previously, during a wiping operation performed by the ink-jet printing apparatus, ink scraped from the larger-diameter nozzles 21 is prevented from approaching and affecting the smaller-diameter nozzles 22. Therefore, appropriate printing can be achieved while preventing a failure to eject ink or a decrease in amount of ink ejected. In this embodiment, the plurality of smaller-diameter nozzles 22 (22A and 22B) constituting the group of smaller-diameter nozzles deviate from the line L1 or L2. Thus, in this point, the configuration of this embodiment is different from that of the second embodiment described previously.

In this embodiment, the lines L1 and L2 each have the larger-diameter nozzles 21 formed at equal intervals. Lines L3 and L4 each have the smaller-diameter nozzles 22 (22A and 22B) formed thereon. In each of the lines L1 and L2, the distance between two larger-diameter nozzles 21 corresponds to a resolution of 300 DPI. The distance between the smaller-diameter nozzles 22A and 22B on each of the lines L3 and L4 corresponds to a resolution of 1200 DPI. The pitch between the center of the larger-diameter nozzle 21 and the point located midway between the smaller-diameter nozzles 22A and 22B corresponds to a resolution of 600 DPI. Further, as is apparent from FIG. 10, in the X direction, the center of the larger-diameter nozzle 21 located on each of the lines L1 and L2 deviates from the center of the smaller-diameter nozzle 22 (22A or 22B) located on each of the lines L3 and L4.

In this embodiment, since the larger-diameter nozzle 21 has a diameter of 23 μm, the larger-diameter nozzles 21 deviate from the smaller-diameter nozzles 22 (22A and 22B) by 30 μm in the X direction. The ink-jet printing head 10 in this example carries out reciprocating printing while moving at a speed of 20 inches/sec in the direction of the arrow X (main-scanning direction). The distance between the nozzles 21 and 22 (22A and 22B) and the sheet P as a printing medium is 1.5 mm. The volume of ink ejected through the larger-diameter nozzle 21 is 10 pl. The volume of ink ejected through the smaller-diameter nozzle 22 (22A or 22B) is 2 pl.

Figure 11:
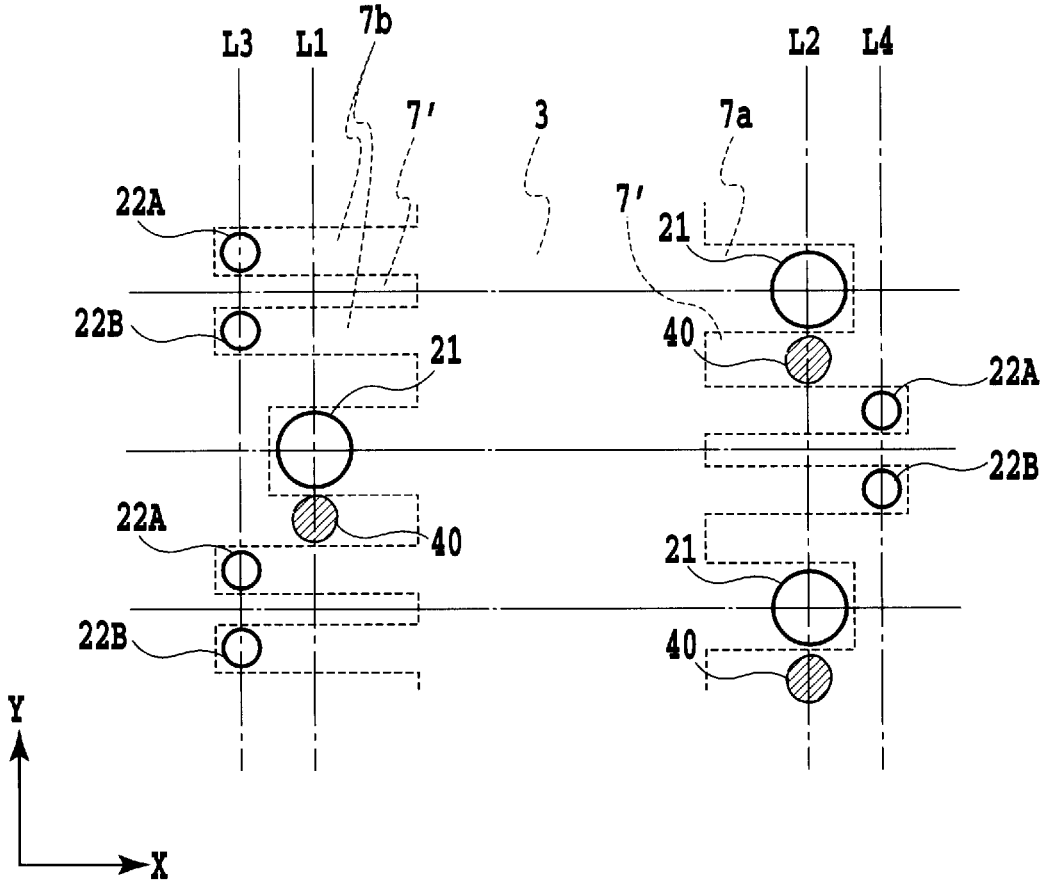
FIG. 11 is a diagram illustrating ink scraped from larger-diameter nozzles in FIG. 10.

With the printing head 10 of this embodiment, ink dots can be formed on the sheet P as a printing medium, as in FIG. 6 described previously. Furthermore, when the surface of the nozzle plate is wiped along a Y direction, ink 40 scraped from the larger-diameter nozzle 21 is not located close to the smaller-diameter nozzles 22 (22A and 22B) as shown in FIG. 11. Thus, appropriate printing can be achieved while preventing a failure to eject ink or a decrease in amount of ink ejected. To prevent the ink 40 scraped from the larger-diameter nozzle 21 from approaching and affecting the smaller-diameter nozzles 22, the amount of deviation of the line L1 or L2 of larger-diameter nozzles 21 from the line L3 or L4 of smaller-diameter nozzles 22 is preferably set to be larger than the diameter of the larger-diameter nozzle 21.

Fourth Embodiment

In this embodiment, the ink channels 7*a* and 7*b* and nozzles are arranged as in FIG. 5, showing the first embodiment described previously. The lines L1 and L2 each have the larger-diameter nozzles 21 and the smaller-diameter nozzles 22 (22A and 22B) formed thereon.

Also in this embodiment, on each of the lines L1 and L2, the group of smaller-diameter nozzles composed of the plurality of smaller-diameter nozzles 22 (22A and 22B) is arranged between two larger-diameter nozzles 21. Accordingly, as in the first embodiment, not only the larger-diameter nozzles 21 but also the smaller-diameter nozzles 22 can be appropriately recovered. Furthermore, in this embodiment, the plurality of smaller-diameter nozzles 22 (22A and 22B) constituting the group of smaller-diameter nozzles are used properly in corresponding with each column as described later. This serves to improve the durability of the electrothermal conversion element 1 corresponding to each smaller-diameter nozzle 22 (22A or 22B).

In this embodiment, the ink-jet printing head 10 constructed as described above carries out reciprocating printing while moving at a speed of 20 inch/sec along the direction of the arrow X (main-scanning direction). That is, reciprocating printing is achieved by forward scanning in a +X direction and backward scanning in a −X direction. The volume of ink ejected through the larger-diameter nozzle 21 is 10 pl. The volume of ink ejected through the smaller-diameter nozzle 22 (22A or 22B) is 2 pl.

Further, if small dots D3 are to be formed, the small dots D3 in a column A are formed using the smaller-diameter nozzles 22A. On the other hand, the small dots D3 in a column B are formed using the smaller-diameter nozzles 22B. Consequently, the small dots D3 in a column A are formed as small dots D3(A), whereas the small dots D3 in a column B are formed as small dots D3(B). In this manner, the smaller-diameter nozzles 22A are used for the column A, while the smaller-diameter nozzles 22B are used for the column B. Consequently, the frequency with which the smaller-diameter nozzles 22 (22A and 22B) are used in the column A equals the frequency with which the smaller-diameter nozzles are used in the column B. As a result, the electrothermal conversion element 1 corresponding to each smaller-diameter nozzle 22 becomes more durable.

Further, in this embodiment, the printing head 10 has a main-scanning speed of 20 inch/sec, so that during a printing operation, the driving frequency for ink ejection is 12 kHz regardless of whether ink is ejected through the larger-diameter nozzles 21 or the smaller-diameter nozzles 22 (22A and 22B). This eliminates the need to increase the driving frequency for ejection of ink through the smaller-diameter nozzles 22 even when a middle-sized dot D2 is to be formed. Further, instead of the ink supply form in which ink is supplied through the ink supply port 3, formed in the center of the substrate 4, as shown in FIGS. 1 and 2, described previously, ink may be supplied from two locations, i.e. the opposite ends of the substrate 4. Both supply forms produce similar effects.

Fifth Embodiment

Figure 12:
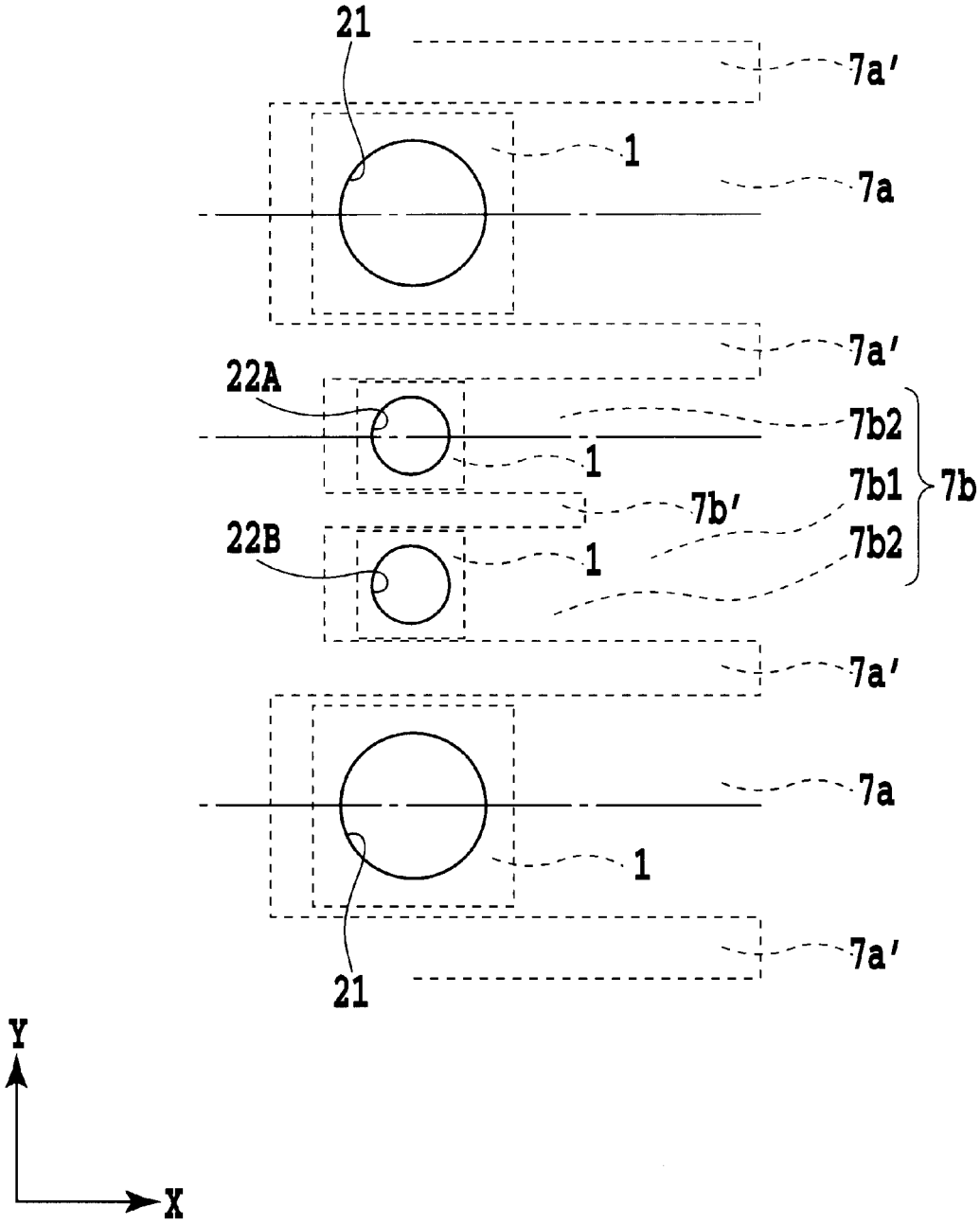
FIG. 12 is a plan view of peripheral portions of nozzles in a printing head according to a fifth embodiment of the present invention.
Figure 13:
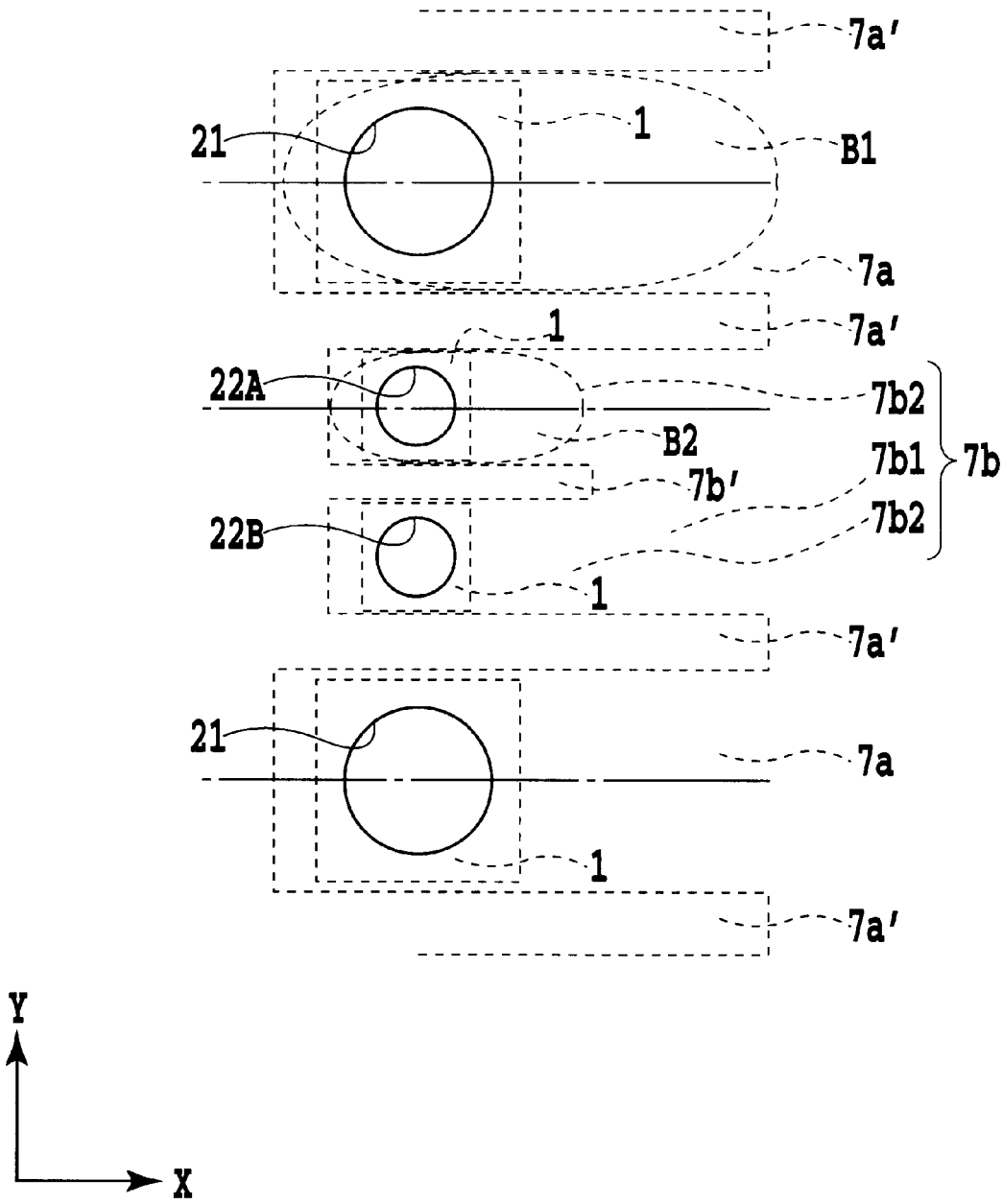
FIG. 13 is a plan view showing that bubbles are generated in the nozzles in FIG. 12.

In this embodiment, as shown in FIG. 12, the nozzles are arranged as in FIG. 5, showing the first embodiment described previously. The lines L1 and L2 each have the larger-diameter nozzles 21 and the smaller-diameter nozzles 22 (22A and 22B) formed thereon. This embodiment differs from the first embodiment in the configuration of ink channels 7*a* and 7*b* that are in communication with the nozzles 22 (22A and 22B) as described later.

Also in FIG. 12, reference numeral 7*a* denotes an ink channel that is in communication with the larger-diameter nozzle 21, and reference numeral 7*b* denotes an ink channel that is in communication with the group of smaller-diameter nozzle 22. The ink channel 7*b* is composed of a common portion 7*b*1 that is in communication with each of the smaller-diameter nozzles 22 (22A and 22B) and branch portions 7*b*2 branching from the common portion 7*b*1 to the respective smaller-diameter nozzles 22 (22A and 22B). The ink channels 7*a* and 7*b* are separated from each other by a channel wall 7*a*'. Further, the branch portions 7*b*2 branching to the respective smaller-diameter nozzles 22 (22A and 22B) are separated from each other by a channel wall 7*b*'. The channel walls 7*a*'and 7*b*'have the same length in the direction in which ink is supplied.

The electrothermal conversion element 1 corresponding to the larger-diameter nozzle 21 has a size of 30×30 μm. The electrothermal conversion element 1 corresponding to the smaller-diameter nozzle 22 (22A or 22B) has a size of 15×15 μm. The latter electrothermal conversion element 1 is thus smaller than the former, so that bubbles B2 generated in the ink channels 7*b*1 and 7*b*2 that are in communication with the smaller-diameter nozzles 22 (22A and 22B) are shorter than bubbles B1 generated in the ink channel 7*a* that is in communication with the larger-diameter nozzle 21. In this embodiment, the channel 7*a*' is set to be longer according to the relatively large length of the bubbles B1. On the other hand, the channel 7*b*' is set to be shorter according to the relatively small length of the bubbles B2.

This configuration of the channel walls 7*a*' and 7*b*' is especially effective in increasing the arrangement density of the ink channels. This is because an increase in arrangement density of the ink channels makes it difficult to provide a sufficient width for the channel wall 7*b*', separating the branch portions 7*b*2 from each other, so that the channel wall 7*b*' becomes weaker. Thus, by setting the channel wall 7*b*' to be shorter than the channel wall 7*a*' as in this embodiment, the channel wall 7*b*' can be prevented from becoming weaker. Accordingly, the ink channels can be more densely arranged by thus setting the channel 7*b*' to be shorter.

Further, when the channel wall 7*b*' is shorter than the channel wall 7*a*', the ink channel 7*b* that is in communication with the smaller-diameter nozzles 22 (22A and 22B) is composed of the common portion 7*b*1 and two branch portions 7*b*2. This configuration reduces the time required to refill the smaller-diameter nozzles 22 (22A and 22B) with ink. Furthermore, the channel wall 7*b*' is set to be shorter, and the common portion 7*b*1 is provided in the ink channel 7*b* that is in communication with the smaller-diameter nozzles 22 (22A and 22B). Then, bubbles can be easily removed from the smaller-diameter nozzles 22 (22A and 22B); otherwise it is more difficult to remove bubbles from the smaller-diameter nozzles 22 (22A and 22B) than from the larger-diameter nozzles 21.

Sixth Embodiment

In this embodiment, the ink channels 7*a* and 7*b* are arranged as in the first embodiment, and the nozzles are arranged substantially as in the first embodiment, shown in FIG. 5. On each of the lines L1 and L2, the group of smaller-diameter nozzles composed of the plurality of smaller-diameter nozzles 22 is arranged between two larger-diameter nozzles 21. Accordingly, as in the first embodiment, not only the larger-diameter nozzles 21 but also the smaller-diameter nozzles 22 can be appropriately recovered.

Figure 14:
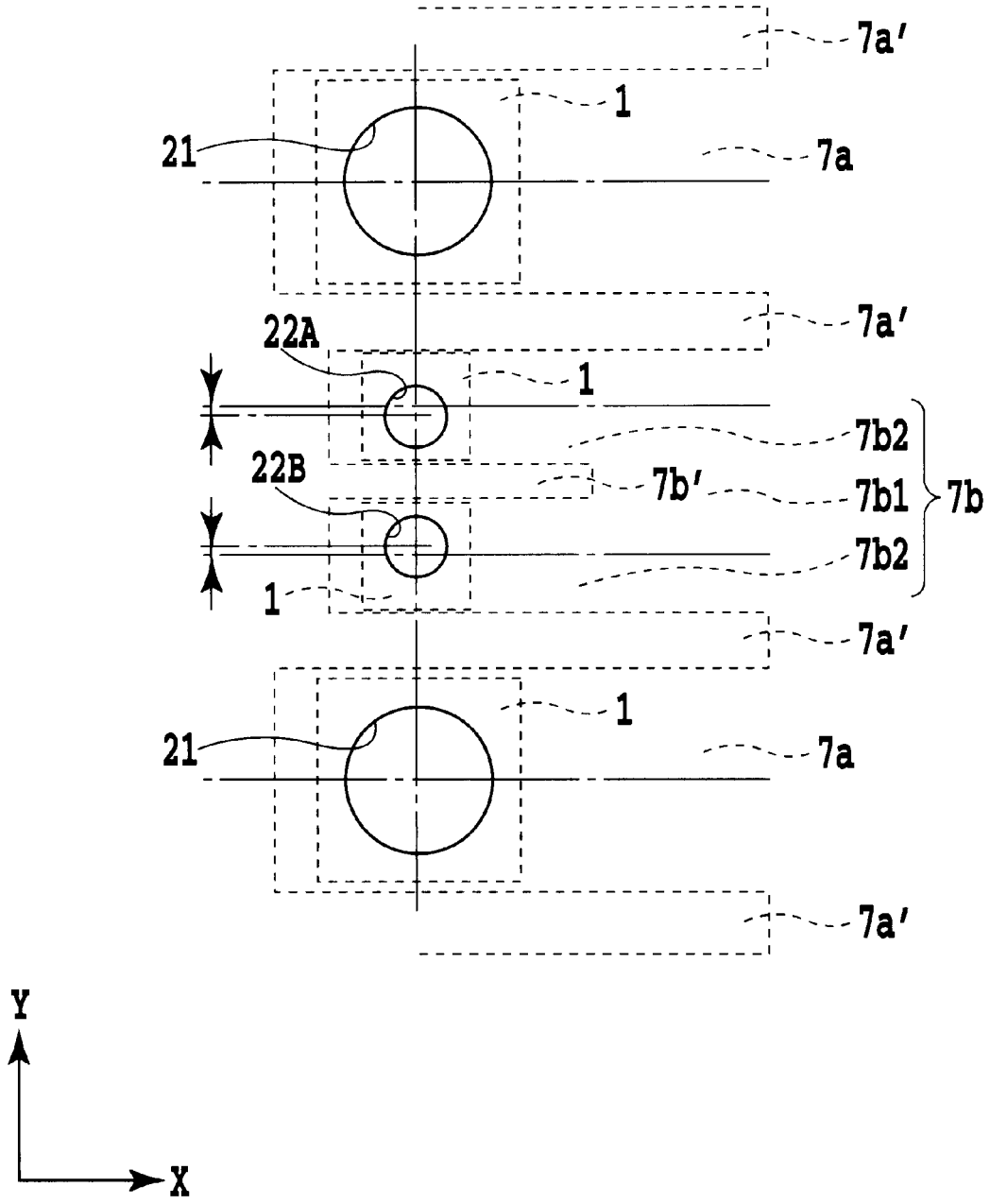
FIG. 14 is a plan view of peripheral portions of nozzles in a printing head according to a sixth embodiment of the present invention.

In this embodiment, as shown in FIG. 14, the center of the smaller-diameter nozzle 22 (22A or 22B) deviates from the center of the corresponding electrothermal conversion element 1 so that ink droplets are obliquely ejected through the smaller-diameter nozzles 22 (22A and 22B). In this configuration, this embodiment differs from the first embodiment described previously. In this embodiment, the center of the smaller-diameter nozzle 22A deviates from the center of the electrothermal conversion element 1 in a −Y direction. The center of the smaller-diameter nozzle 22B deviates from the center of the electrothermal conversion element 1 in a +Y direction. The center of the larger-diameter nozzle 21 is aligned with the center of the electrothermal conversion element 1.

Figure 15:
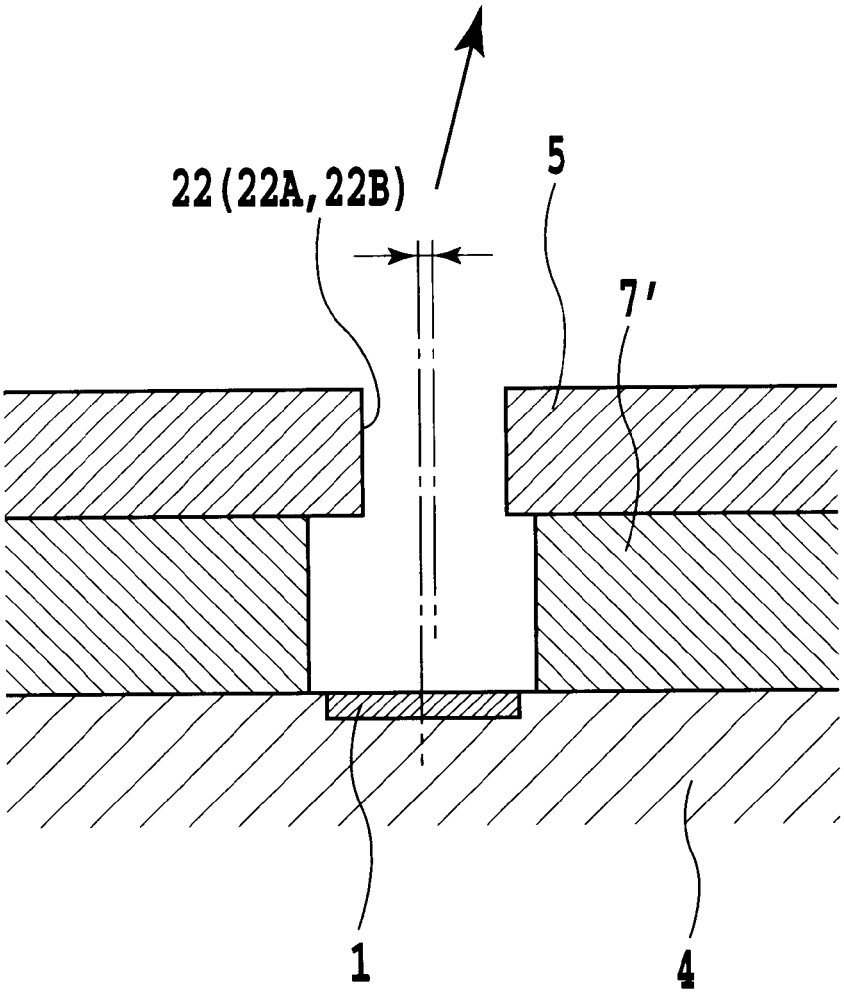
FIG. 15 is a sectional view of a smaller-diameter nozzle in the printing head shown in FIG. 14.

Since the center of the smaller-diameter nozzle 22 (22A or 22B) deviates from the center of the electrothermal conversion element 1, bubbles generated by thermal energy from the electrothermal conversion element 1 grow in the direction of the deviation of the smaller-diameter nozzle 22. Then, an ink droplet is obliquely ejected in the direction of the deviation of the smaller-diameter nozzle 22 as shown by the arrow in FIG. 15. In this example, the volume of ink ejected through the larger-diameter nozzle 21 is 10 pl. The volume of ink ejected through the smaller-diameter nozzle 22 is 2 pl.

Figure 16:
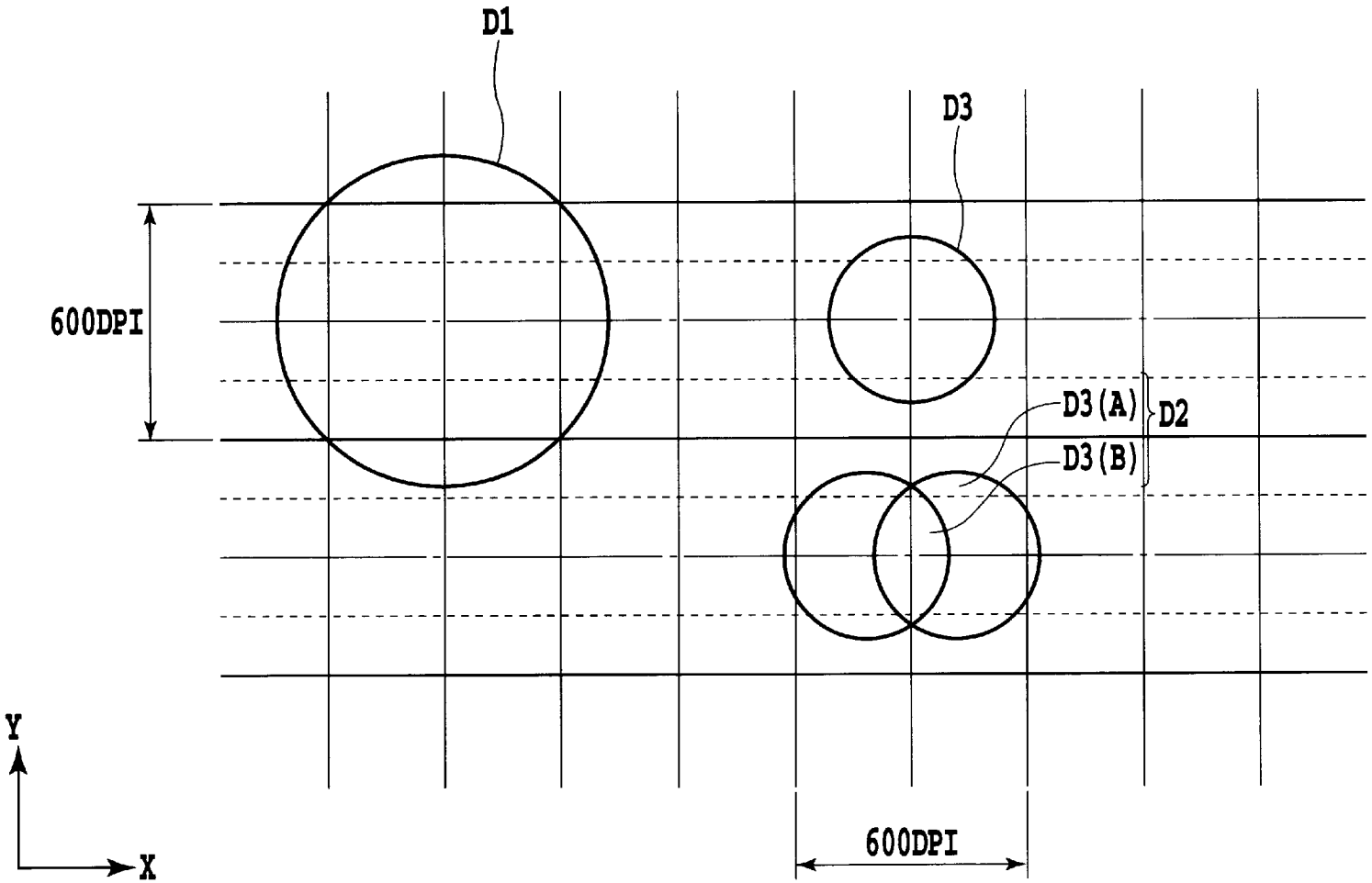
FIG. 16 is a diagram illustrating dots that can be formed using the printing head shown in FIG. 14.

FIG. 16 is a diagram illustrating the arrangement of dots formed by thus obliquely ejected ink droplets.

Within a unit print area of 600×600 DPI, a large dot D1 is formed by an ink droplet ejected through the larger-diameter nozzle 21, and a small dot D3 is formed by an ink droplet ejected through the smaller-diameter nozzle 22 (22A or 22B). Further, a middle-sized dot D2 is formed by small dots D3(A) and D3(B) formed by the smaller-diameter nozzles 22A and 22B located adjacent to each other in the direction of the arrow Y (sub-scanning direction). As in the first embodiment described previously, when the lines L1 and L2 deviate from each other by a distance corresponding to 2400 DPI, a middle-sized dot D2 can be formed within a print area of 600×600 DPI. Further, in this example, the printing head 10 has a main-scanning speed of 20 inch/sec, so that during a printing operation, the driving frequency for ink ejection is 12 kHz regardless of whether ink is ejected through the larger-diameter nozzles 21 or the smaller-diameter nozzles 22. This eliminates the need to increase the driving frequency for ejection of ink through the smaller-diameter nozzles 22 even when the middle-sized dot D2 is to be formed.

Seventh Embodiment

In this embodiment, the channels 7*a* and 7*b* and the nozzles are arranged substantially as in the first embodiment shown in FIG. 5. On each of the lines L1 and L2, a group of smaller-diameter nozzles composed of a plurality of smaller-diameter nozzles 22 (22A and 22B) is arranged between two larger-diameter nozzle 21.

In this embodiment, attention is focused on deviation of the timings with which ink is ejected through the nozzles 21 and 22.

Figure 17:
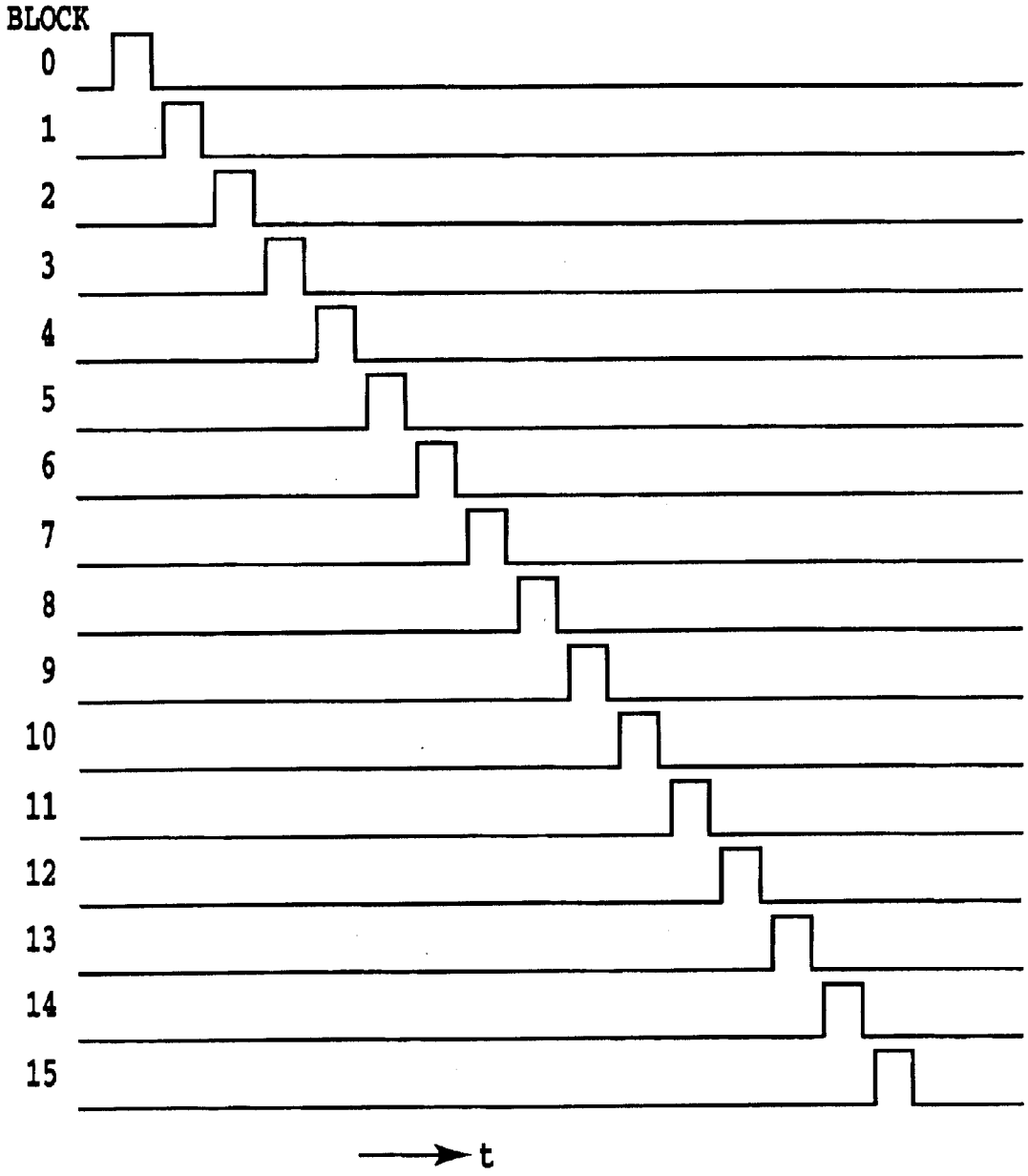
FIG. 17 is a time chart illustrating block driving for a printing head according to a seventh embodiment of the present invention.
Figure 18A:
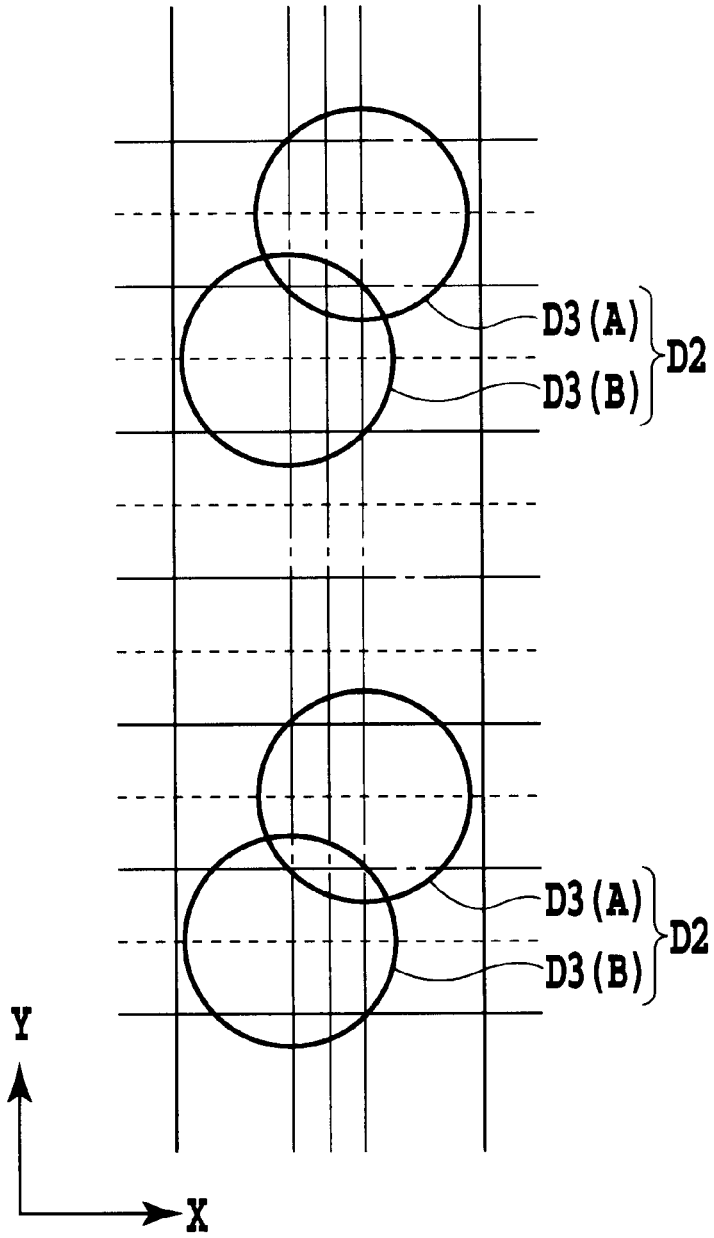
FIGS. 18A, 18B and 18C are diagrams illustrating dots that can be formed using the printing head shown in FIG. 17.
Figure 18B:
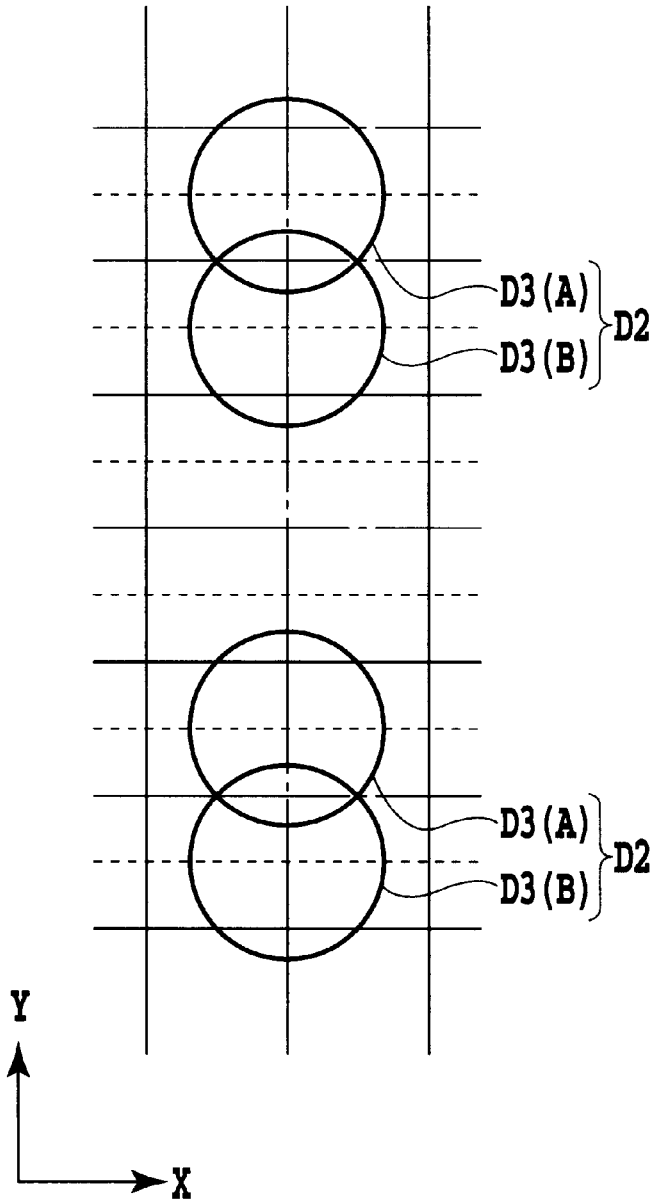
Figure 18C:
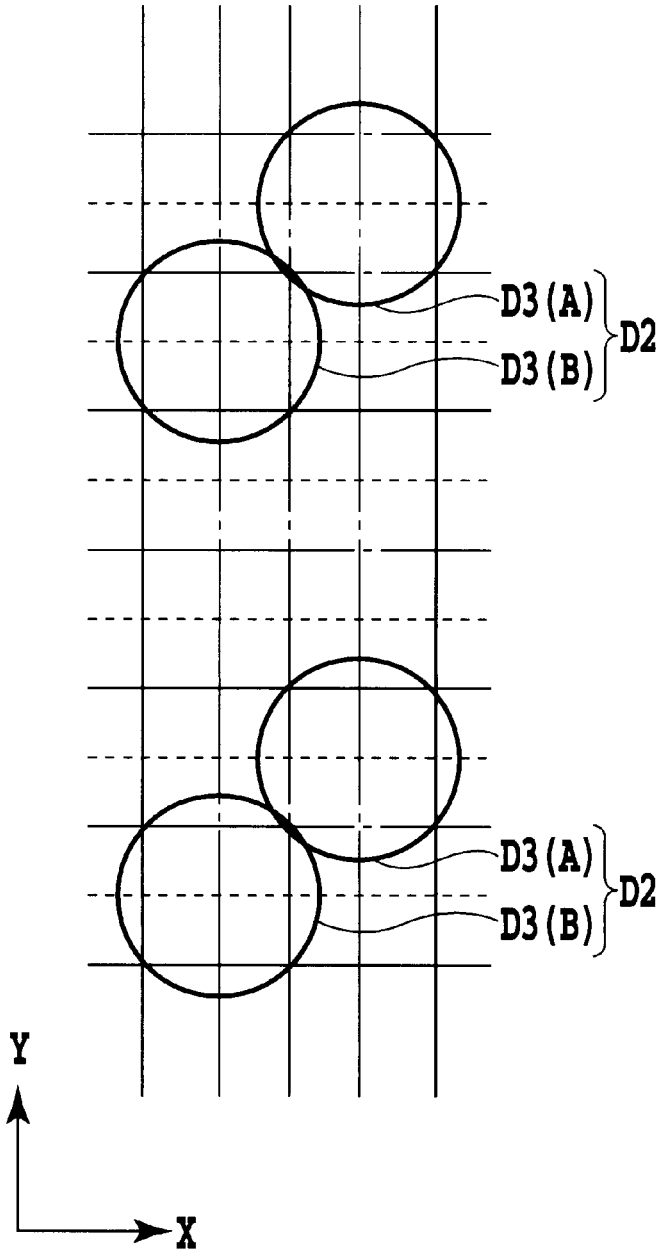

That is, in this embodiment, to reduce current fed to the ink-jet printing head at the same time, the timings with which ink is ejected through the respective nozzles are allowed to deviate from each other. For example, as shown in FIG. 17, ink ejection timings are set on the basis of 16 blocks. Then, as shown in FIG. 18A, uniform middle-sized dots D2 can be formed by setting the difference in ink ejecting timing between the smaller-diameter nozzles 22A and 22B at 1.9 μs. Alternatively, as shown in FIG. 18B, uniform elongate middle-sized dots D2 can be formed by setting the ink ejection timings for the smaller-diameter nozzles 22A and 22B at the same value. Further, the difference in ink ejecting timing between the smaller-diameter nozzles 22A and 22B can be set at an intermediate value for the 16 blocks in FIG. 17, specifically a value close to a block 8. Such a setting allows ink droplets ejected through the smaller-diameter nozzles 22A and 22B to obliquely form dots D3(A) and D3(B), as shown in FIG. 18C. As a result, the middle-sized dot D2 has a larger dot area than the elongate dot in FIG. 18B. Correspondingly, the size of each of the small dots D3(A) and D3(B) can be reduced to lessen granular feeling and the like, thereby improving image quality.

Eighth Embodiment

Figure 19:
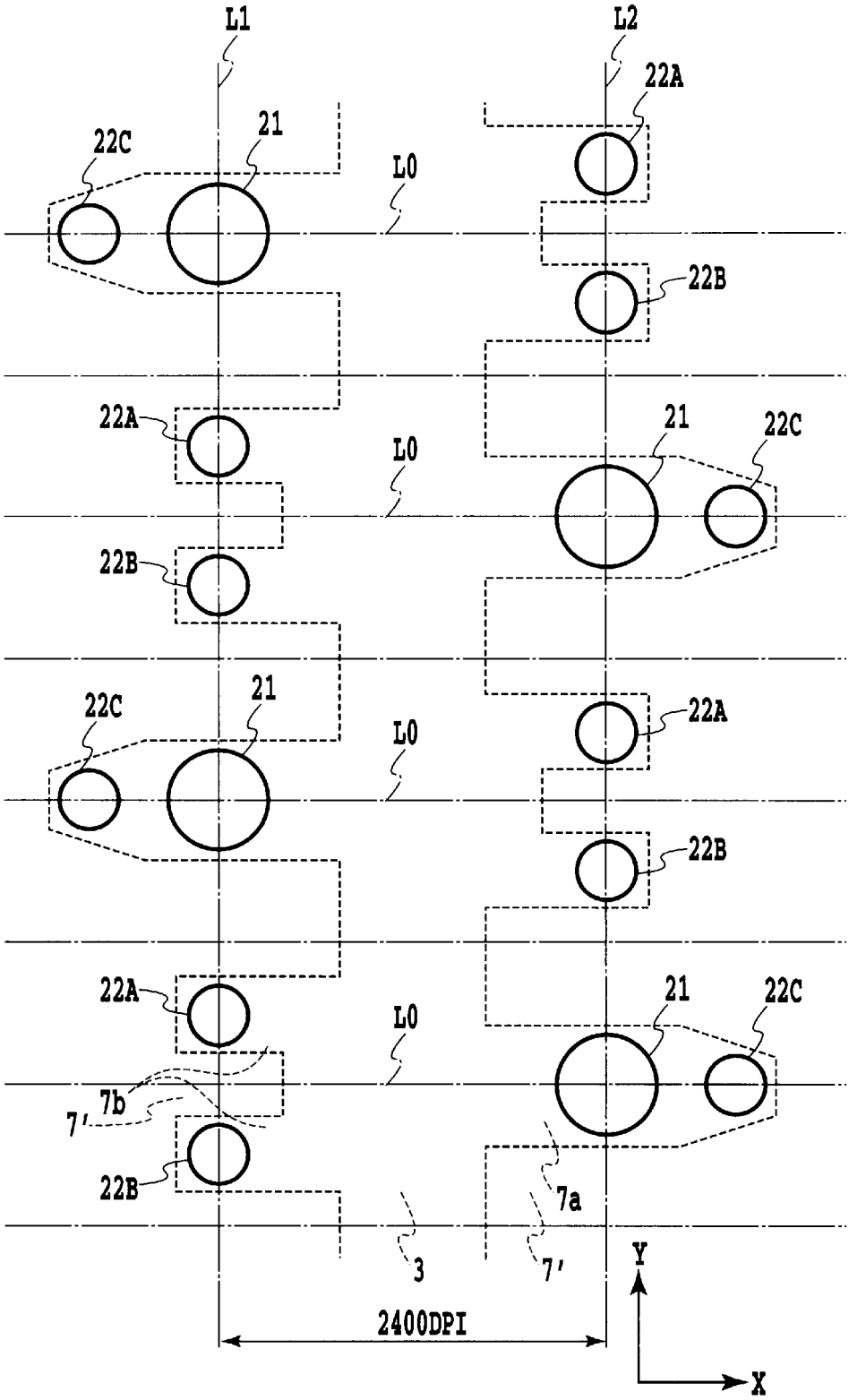
FIG. 19 is a plan view showing an essential part of a printing head according to an eighth embodiment of the present invention.

FIG. 19 is a schematic plan view showing an essential part of the printing head 10 according to an eighth embodiment of the present invention. In this embodiment, a smaller-diameter nozzle 22C in communication with the common ink channel 7*a* communicated with the lager-diameter nozzle 21 is arranged by the side of the larger-diameter nozzle 21 in the main-scanning direction of the printing head. Such nozzle amendment of this embodiment is added to that of the first embodiment shown in FIG. 5. An arrangement of the other smaller-diameter nozzles 22A and 22B, and a shape of the ink channel 7*b* in communication with the smaller-diameter nozzles 22A and 22B are the same as the first embodiment shown in FIG. 5.

Also in this embodiment, the plurality of smaller-diameter nozzles 22 are formed between two larger-diameter nozzles 21. Thus, as in the first embodiment, not only the larger-diameter nozzles 21 but also the smaller-diameter nozzles 22 can be appropriately recovered.

Figure 20:
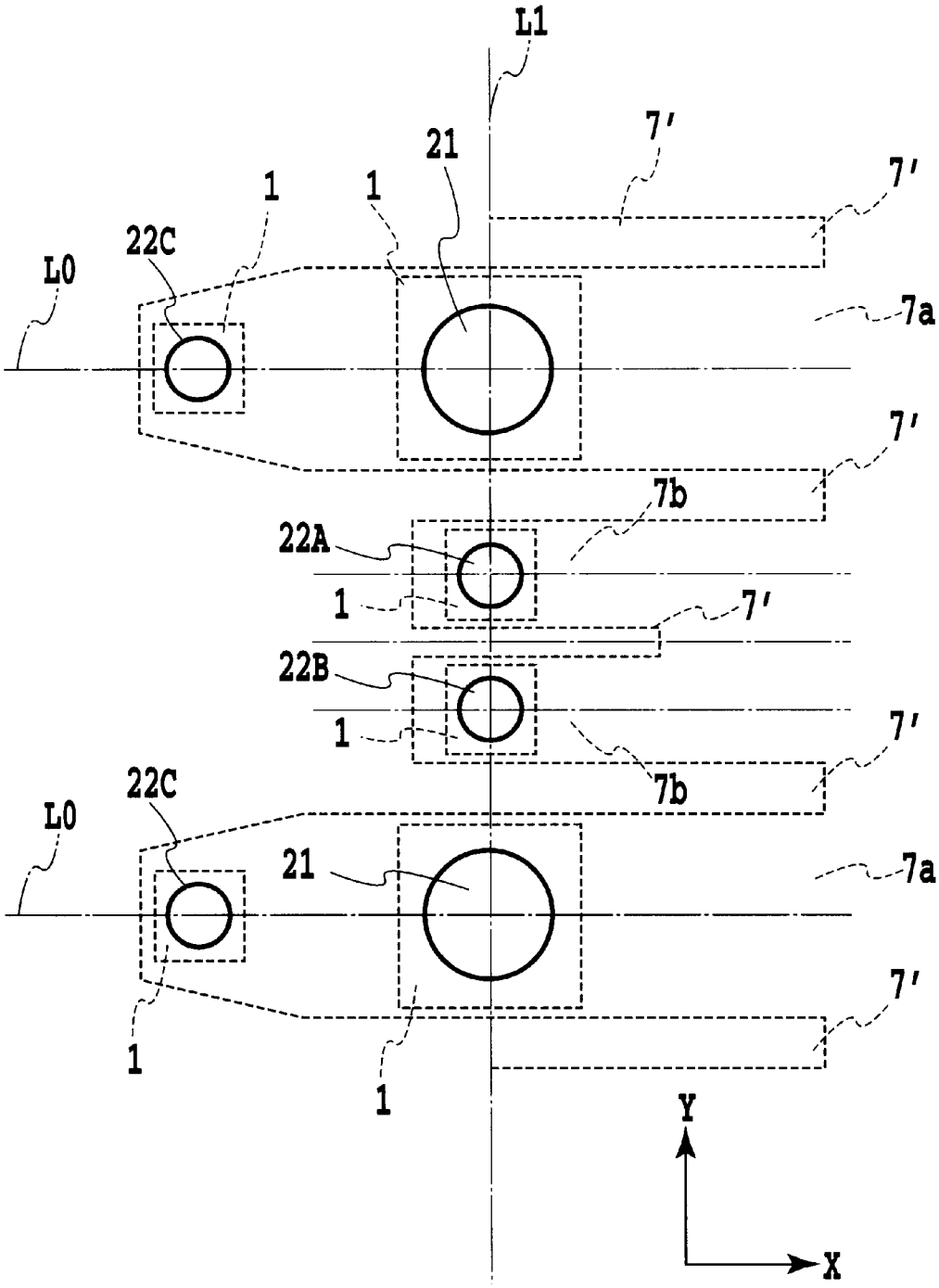
FIG. 20 is an enlarged view of a channel structure in the printing head shown in FIG. 19.

FIG. 20 more specifically illustrates a channel structure in this embodiment. One ink channel 7 is formed for one larger-diameter nozzle 21 and one smaller-diameter nozzle 22C. Furthermore, the electrothermal conversion element 1 is formed at the position corresponding to each of the nozzles, and has a size corresponding to this nozzle. Thus, the ink channel 7 with the larger-diameter nozzle 21 and smaller-diameter nozzle 22C located therein is provided with the larger-sized electrothermal conversion element 1 corresponding to the larger-diameter nozzle 21 and the smaller-sized electrothermal conversion element 1 corresponding to the smaller-diameter nozzle 22*c*. The centerline of the larger-diameter nozzle 21 coincides with the centerline of the smaller-diameter nozzle 22C in the X direction (main-scanning direction).

In this example, a printing operation is performed by scanning the ink-jet printing head 10 constructed as described at a speed of 10 inch/sec in the direction of the arrow X (main-scanning direction). The volume of ink ejected through the larger-diameter nozzle 21 is 10 pl. The volume of ink ejected through the smaller-diameter nozzle 22 (22A, 22B, or 22C) is 2 pl.

Figure 21:
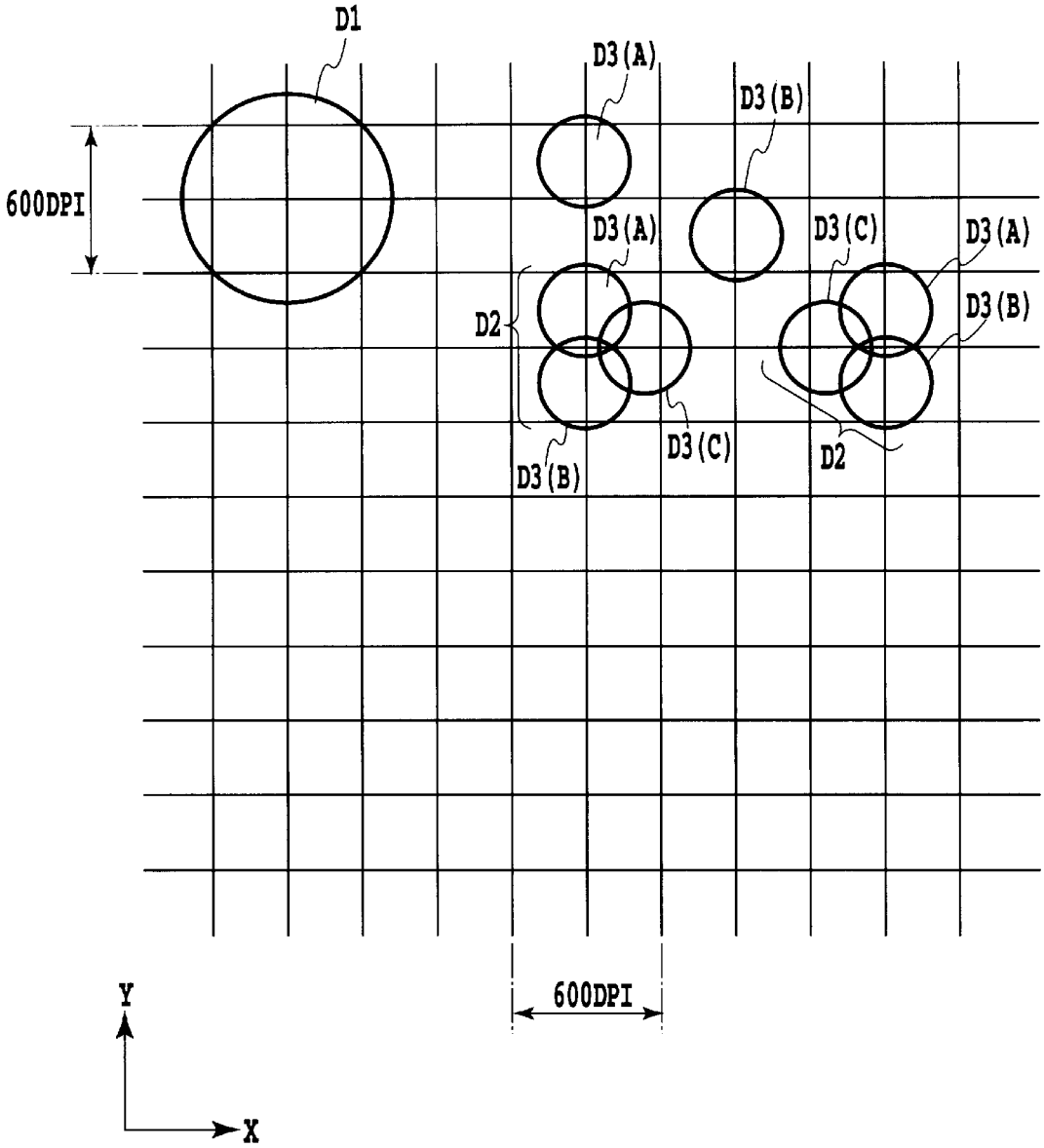
FIG. 21 is a diagram illustrating dots that can be formed using the printing head shown in FIG. 19.

FIG. 21 is a diagram illustrating dots formed on a printing medium. Within a unit print area of 600×600 DPI, a large dot D1 is formed by an ink droplet ejected through the larger-diameter nozzle 21, and a small dot D3 is formed by an ink droplet ejected through the smaller-diameter nozzle 22A or 22B. A middle-sized dot D2 is formed by three small dots D3 (D3(A), D3(B), and D3(C)). The small dots D3(A) and D3(B) are formed by ink droplets ejected through the smaller-diameter nozzles 22A and 22B arranged so as to deviate from each other in the direction of the arrow Y (sub-scanning direction). Further, the small dot D3(C) is formed by an ink droplet ejected through the smaller-diameter nozzle 22C, located by the side of the larger-diameter nozzle 21.

Figure 22A:
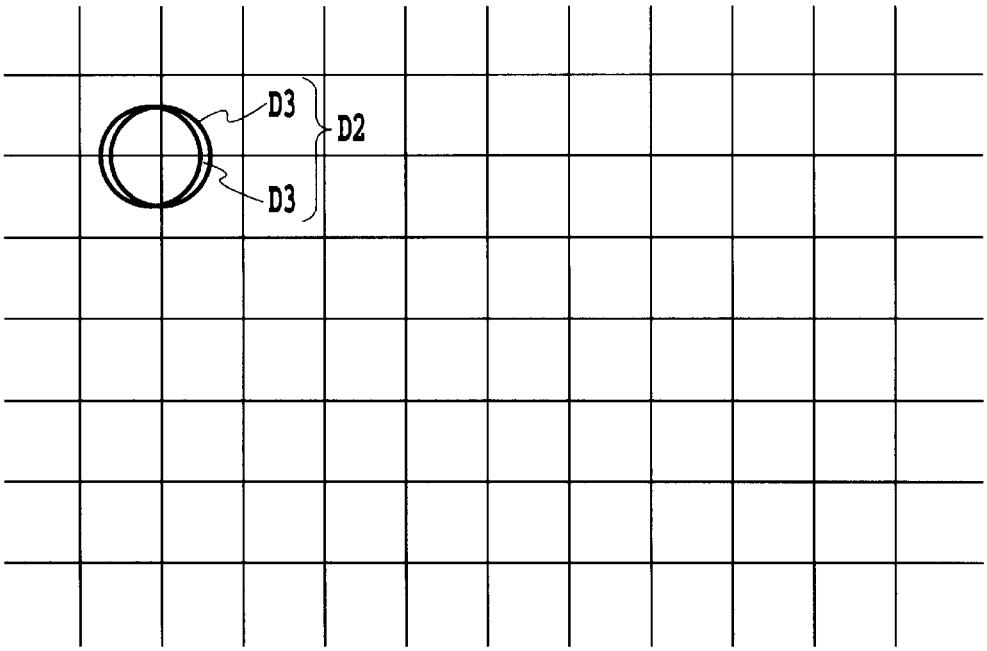
FIGS. 22A and 22B are diagrams illustrating problems of a conventional ink-jet printing head.

When the lines L1 and L2 thus deviate from each other by a distance corresponding to a resolution of 2400 DPI, a middle-sized dot D2 can be formed within a unit print area of 600×600 DPI. In this case, a printing operation can be performed by causing the printing head to perform a main-scanning operation at a speed of 20 inch/sec and ejecting ink through each of the larger-diameter nozzles 21 and smaller-diameter nozzles 22 (22A, 22B, and 22C) with a driving frequency of 12 kHz. This eliminates the need to increase the driving frequency for the smaller-diameter nozzles 22 (22A, 22B, and 22C) even when the middle-sized dot D2 is to be formed. Furthermore, the middle-sized dot D2 is formed by three small dots D3 and is thus larger than that formed by placing two small dots D3 on each other as shown in FIG. 22A. As a result, the area of the middle-sized dot D2 increases relative to the amount of the ink ejected, thereby ensuring that ink can be fixed to a surface layer of a printing medium. Furthermore, the middle-sized dot D2 has a stable size in spite of a difference in amount of ejecting ink between the smaller-diameter nozzles 22.

Figure 22B:
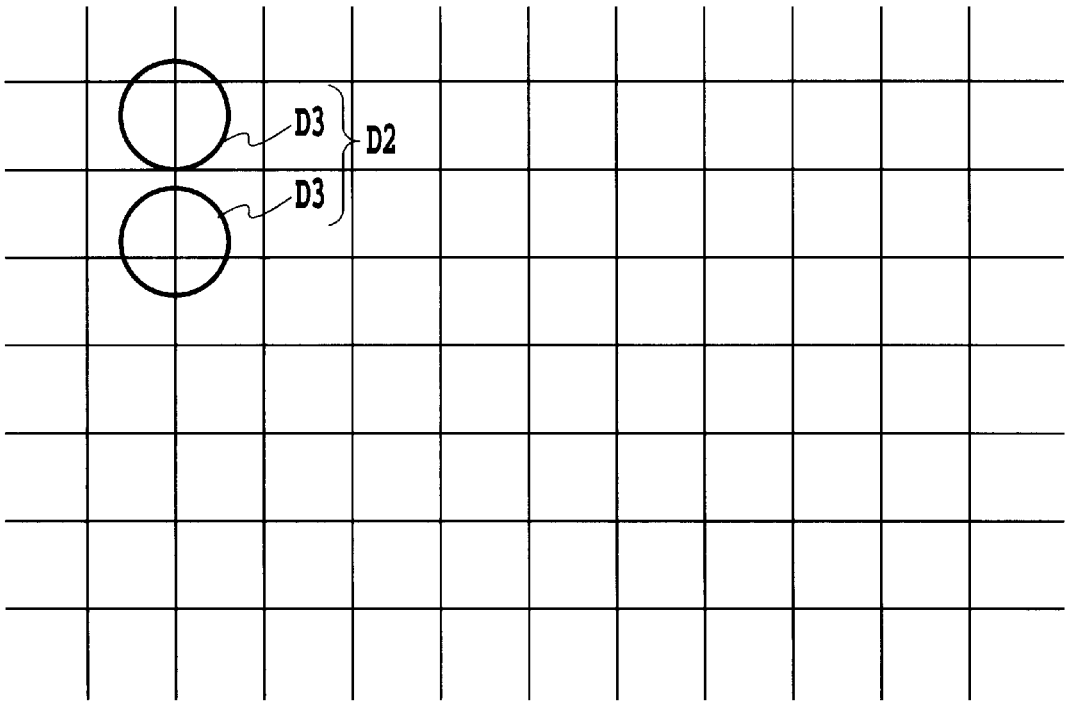

Further, in this embodiment, image grade can be improved compared to the case where the middle-sized dot D2 is formed by two small dots D3. For example, it is assumed that the middle-sized dot D2 is formed by two small dots D3 formed by the smaller-diameter nozzles 22A and 22B. Then, when ink droplets ejected through the smaller-diameter nozzles 22A and 22B imprecisely impact a printing medium in the Y direction, the small dots D3 are separated from each other, as shown in FIG. 22B. Consequently, unwanted stripes may appear in a printed image, or the density of the image may not be uniform. However, when the middle-sized dot D2 is formed by three small dots D3 (D3(A), D3(B), and D3(C)) as in this embodiment, both unwanted stripes and nonuniform density are avoided even if ink droplets forming these small dots D3 imprecisely impact the printing medium in the Y direction. Further, in this embodiment, the number of smaller-diameter nozzles 22 is three times as large as that of larger-diameter nozzles 21. Accordingly, printed images are free from unwanted stripes and nonuniform density, and large middle-sized dots D2 are stably obtained. Moreover, throughput is prevented from decreasing even if a photograph-grade image is to be printed.

Ninth Embodiment

Figure 23A:
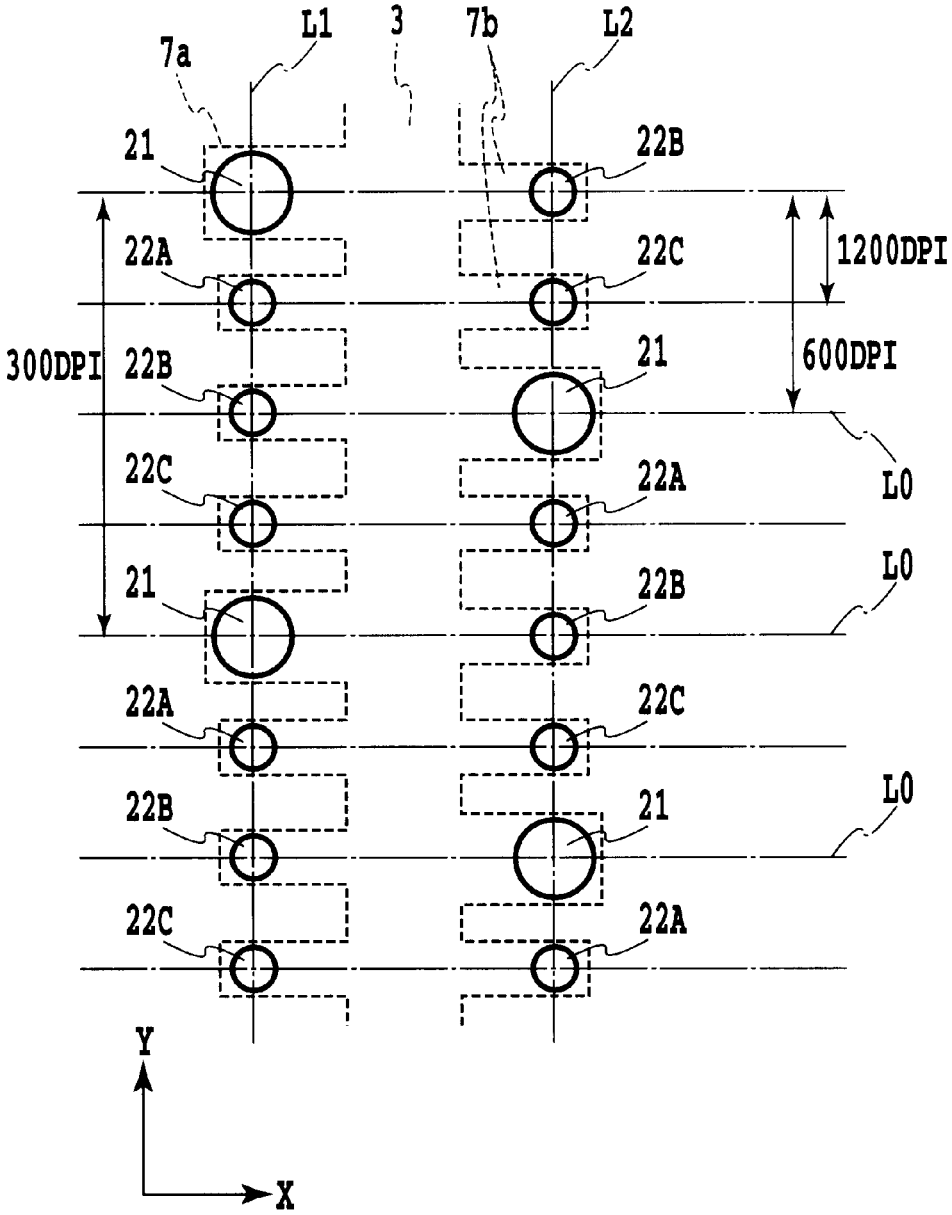
FIG. 23A is a plan view showing an example of a configuration of a printing head according to a ninth embodiment of the present invention.
Figure 23B:
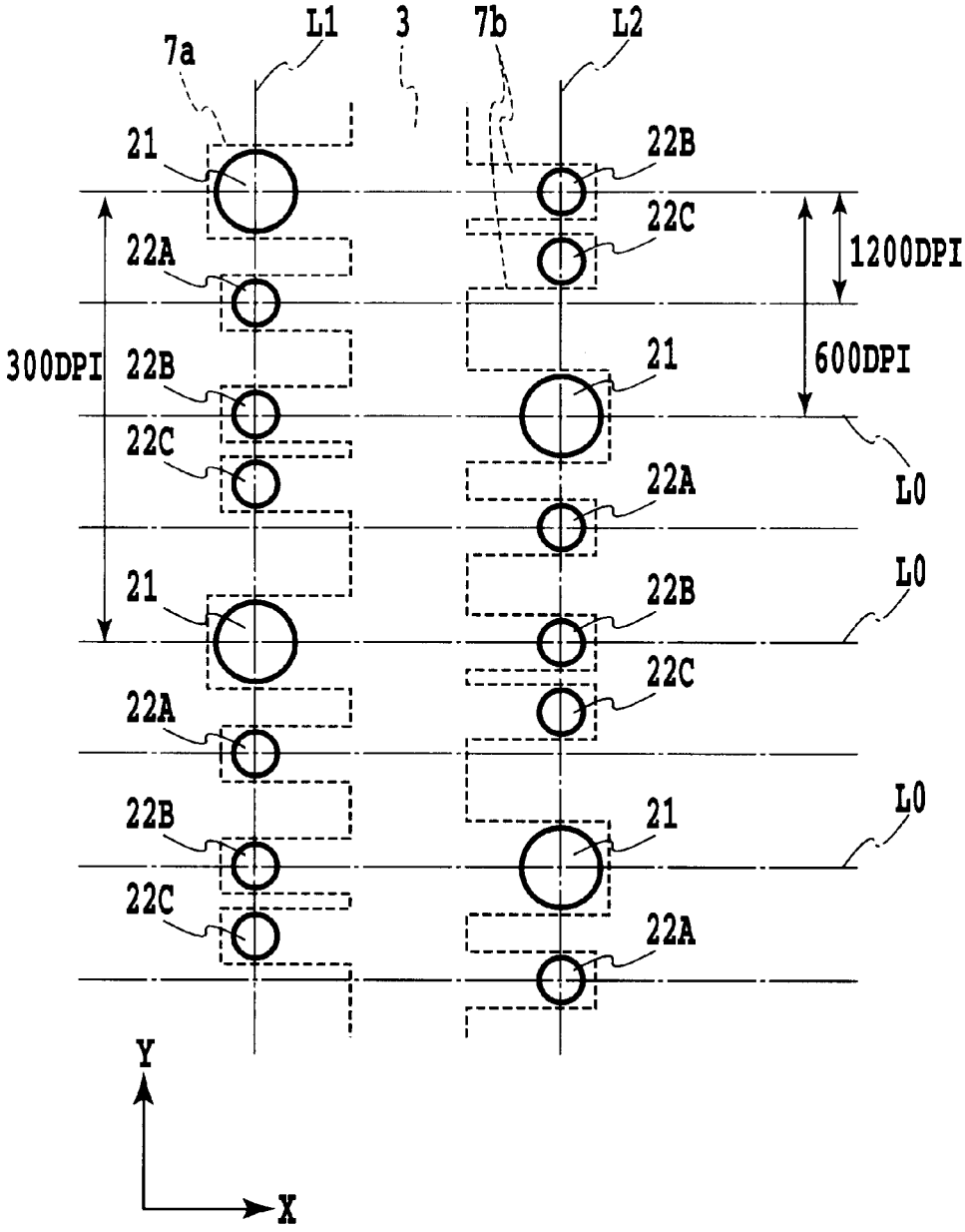
FIG. 23B is a plan view showing another example of a configuration of a printing head according to the ninth embodiment of the present invention.

In this embodiment, along the ink supply port 3, the ink channel 7*a* in communication with the larger-diameter nozzles 21 alternates with three ink channels 7*b* in communication with the smaller-diameters respectively. The larger-diameter nozzles and smaller-diameter nozzles are formed on the same line. On this line, three smaller-diameter nozzles are arranged between two larger-diameter nozzles. These nozzles may be arranged as shown in FIG. 23A or 23B. FIGS. 23A and 23B are plan views of an essential part of an ink-jet printing head according to this embodiment.

In FIGS. 23A and 23B, the distance between the larger-diameter nozzle 21 on the line L1 and the larger-diameter nozzle 21 on the line L2 corresponds to a resolution of 600 DPI. Further, in each of the lines L1 and L2, the distance between two larger-diameter nozzles 21 corresponds to a resolution of 300 DPI. The center of the larger-diameter nozzle 21 on the line L1 or L2 coincides with the center of the smaller-diameter nozzle 22B on the line L2 or L1, respectively (centerline L0).

Further, in FIG. 23A, the distance between two of the three smaller-diameter nozzles 22A, 22B, and 22C, located between two larger-diameter nozzles 21 corresponds to a resolution of 1200 DPI. In FIG. 23B, the distance between the smaller-diameter nozzle 22A on the line L1 or L2 and the smaller-diameter nozzle 22B on the line L2 and L1, respectively, corresponds to a resolution of 1200 DPI. The smaller-diameter nozzle 22C is arranged at the intermediate position between these smaller-diameter nozzles 22A and 22B in the Y direction.

In the ink-jet printing head shown in FIGS. 23A and 23B, ink from the ink storage section (not shown) is filled into the nozzles via the ink supply port through a sucking or pressurizing operation performed by the ink-jet printing apparatus, as in the embodiments described previously.

In this embodiment, three smaller-diameter nozzles 22A, 22B, and 22C are arranged between two larger-diameter nozzles 21 on the same line. Accordingly, ink can be filled into the nozzles through a sucking or pressurizing operation performed by the ink-jet printing apparatus, while preventing bubbles from remaining in the ink supply port or in other areas. Further, in this embodiment, the ink supply port is formed in the center of the substrate. However, similar effects are produced if ink is supplied from two locations, i.e. the opposite ends of the substrate. Furthermore, in this example, the ink-jet printing head shown in FIGS. 23A and 23B performs a printing operation while scanning a printing medium at a speed of 20 inch/sec in the direction of the arrow X (main-scanning direction). The volume of ink ejected through the larger-diameter nozzle 21 is 10 pl. The volume of ink ejected through the smaller-diameter nozzle 22 (22A, 22B, or 22C) is 2 pl.

Figure 24A:
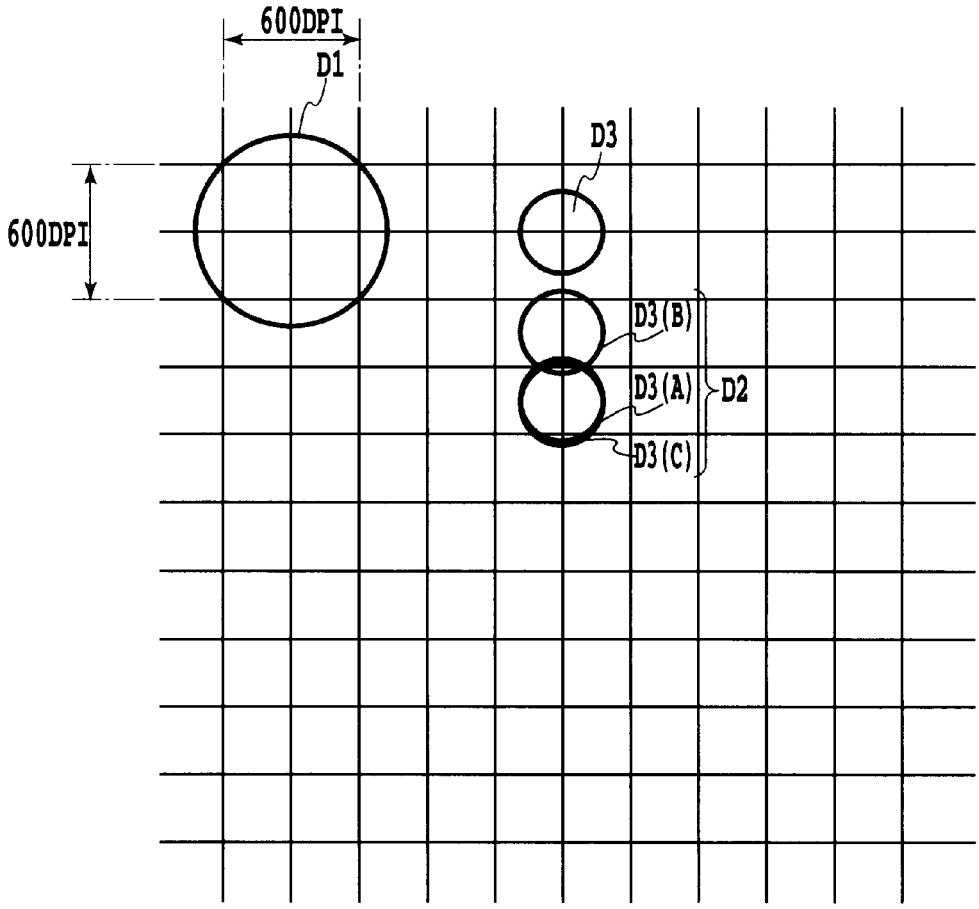
FIG. 24A is a diagram illustrating dots that can be formed using the printing head shown in FIG. 23A.
Figure 24B:
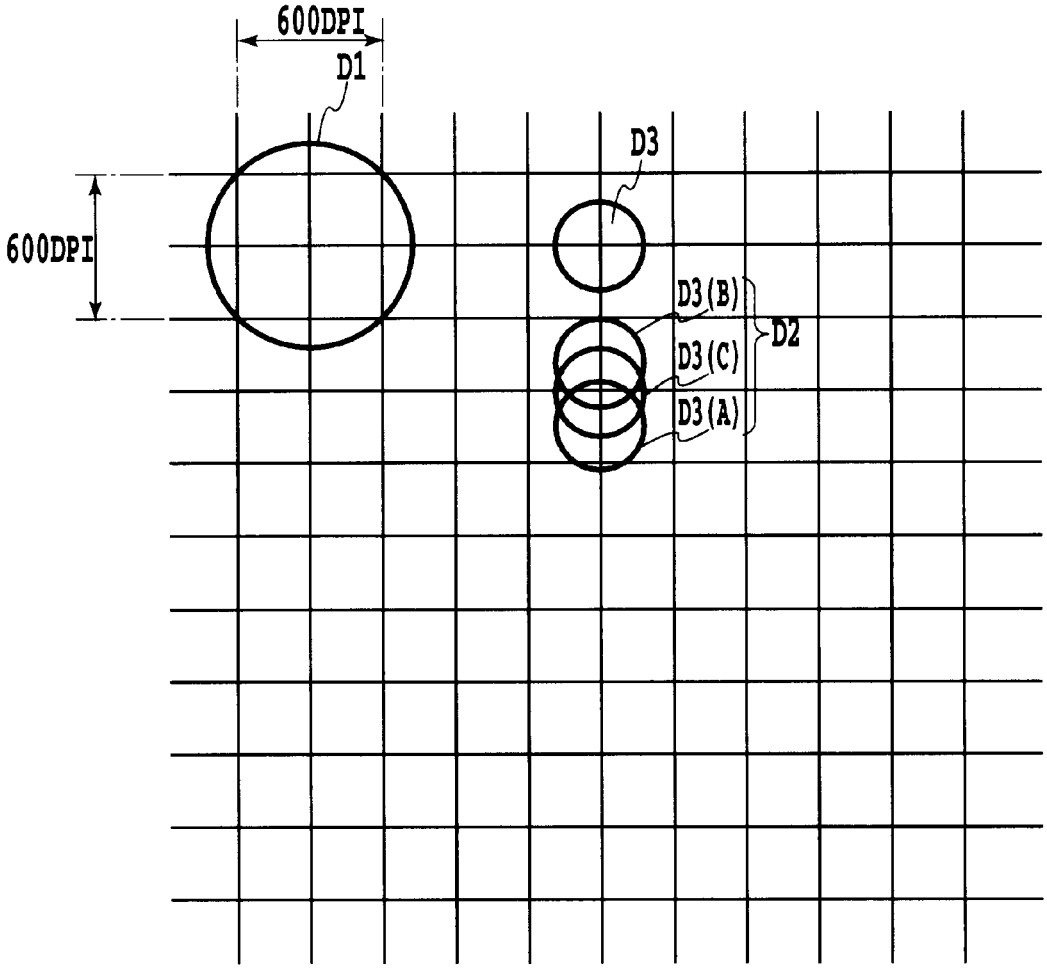
FIG. 24B is a diagram illustrating dots that can be formed using the printing head shown in FIG. 23B.

FIG. 24A is a diagram illustrating the arrangement of dots formed on the printing medium using the printing head shown in FIG. 23A. FIG. 24B is a diagram illustrating the arrangement of dots formed on the printing medium using the printing head shown in FIG. 23B. Within a unit print area of 600×600 DPI, a large dot D1 is formed by an ink droplet ejected through the larger-diameter nozzle 21, and a small dot D3 is formed by an ink droplet ejected through the smaller-diameter nozzle 22 (22A, 22B, or 22C). Further, a middle-sized dot D2 is formed by ink droplets ejected through the three smaller-diameter nozzles 22A, 22B, and 22C. In FIG. 24A, small dots D3(A), D3(B), and D3(C) are formed by ink droplets ejected through the three smaller-diameter nozzles 22A, 22B, and 22C, respectively. The middle-sized dot D2 is formed by these three dots D3(A), D3(B), and D3(C). In this case, a printing operation can be performed by causing the printing head to perform a main-scanning operation at a speed of 20 inch/sec and ejecting ink through each of the larger-diameter nozzles 21 and smaller-diameter nozzles 22 (22A, 22B, and 22C) with a driving frequency of 12 kHz. This eliminates the need to increase the driving frequency for the smaller-diameter nozzles 22 even when the middle-sized dot D2 is to be formed.

Further, the middle-sized dot D2 is formed as shown in FIG. 24B when the smaller-diameter nozzles 22B and 22C deviate by half the resolution of the smaller-diameter nozzles 22 as shown in FIG. 23B. When the middle-sized dot D2 is formed in this manner, both unwanted stripes in a printed image and the nonuniform density thereof are avoided even if ink droplets forming these small dots D3 imprecisely impact the printing medium in the Y direction. Furthermore, large middle-sized dots D2 are stably obtained, and high-grade images can be printed. In this embodiment, the number of smaller-diameter nozzles 22 is three times as large as that of larger-diameter nozzles 21. Accordingly, throughput is prevented from decreasing even if a photograph-grade image is to be printed.

Tenth Embodiment

Next, the arrangement of the ink channels 7*a* and 7*b* and the nozzles in this embodiment are the same as that in the ninth embodiment described previously.

Figure 25A:
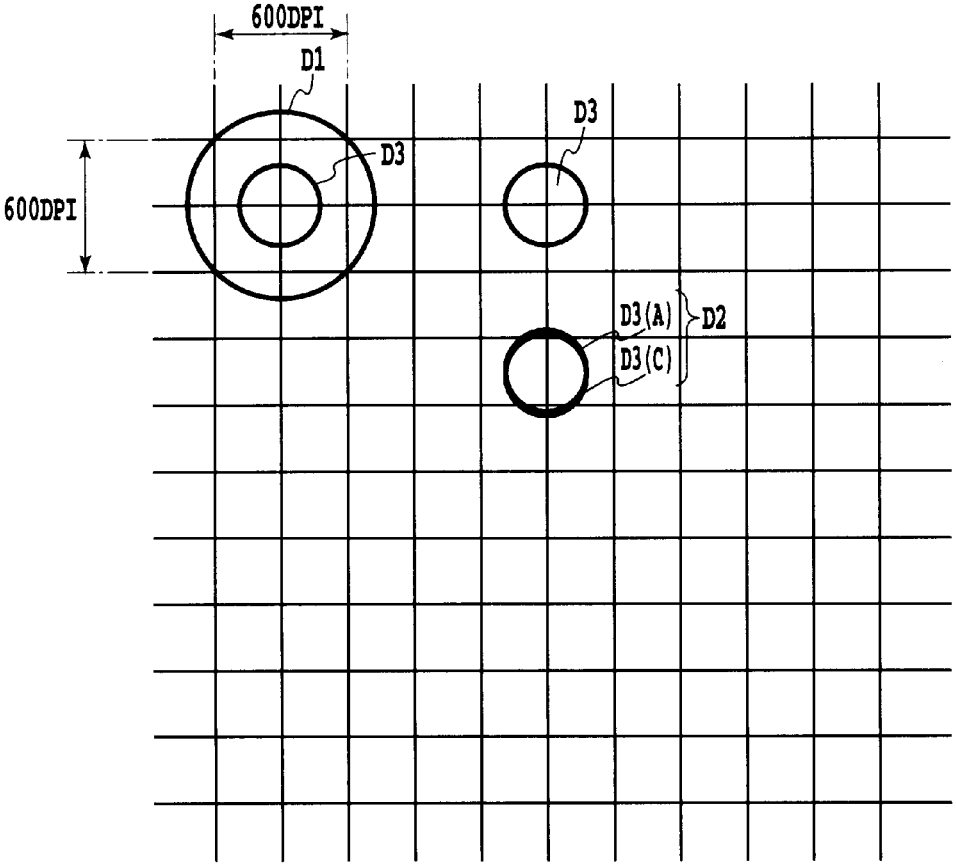
FIG. 25A is a diagram of a tenth embodiment of the present invention, showing dots that can be formed using the printing head shown in FIG. 23A.
Figure 25B:
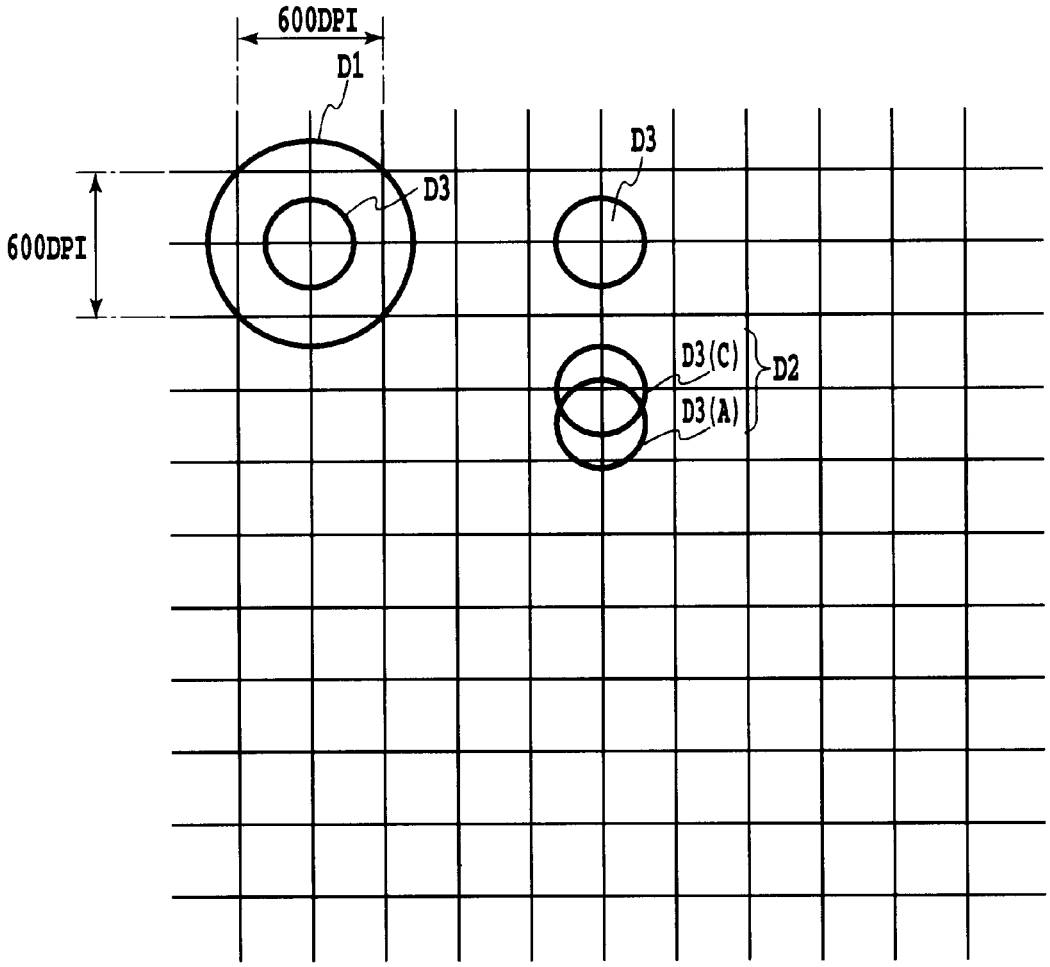
FIG. 25B is a diagram of the tenth embodiment of the present invention, showing dots that can be formed using the printing head shown in FIG. 23B.

In this embodiment, the volume of ink ejected through the larger-diameter nozzle 21 is 8 pl. The volume of ink ejected through the smaller-diameter nozzle 22 (22A, 22B, or 22C) is 2 pl. A method of forming large dots and middle-sized dots D2 is different from that used in the ninth embodiment. FIG. 25A is a diagram illustrating the arrangement of dots formed on a printing medium using the printing head shown in FIG. 23A, according to this embodiment. Further, FIG. 25B is a diagram illustrating the arrangement of dots formed on a printing medium using the printing head shown in FIG. 23B, according to this embodiment.

In this embodiment, within a unit print area of 600 ×600 DPI, a large dot is formed by placing ink droplets on each other which are ejected through one larger-diameter nozzle 21 and one smaller-diameter nozzle 22, respectively. Further, a small dot D3 is formed by an ink droplet ejected through the smaller-diameter nozzle 22 (22A, 22B, or 22C). Furthermore, a middle-sized dot D2 is formed by ink droplets ejected through two smaller-diameter nozzles 22 arranged in the main-scanning direction, that is, by two small dots D3. In FIG. 25A, the middle-sized dot D2 is formed by these three dots D3(A), D3(B), and D3(C). In this case, the small dot D3(A) is formed by the smaller-diameter nozzle 22A on the line L1 or L2 in FIG. 23A, whereas the small dot D3(C) is formed by the smaller-diameter nozzle 22C on the line L2 or L1, respectively, in FIG. 23A. Similarly, in FIG. 25A, the middle-sized dot D2 is formed by the small dots D3(A) and D3(C). In this case, the small dot D3(A) is formed by the smaller-diameter nozzle 22A on the line L1 or L2 in FIG. 23B, whereas the small dot D3(C) is formed by the smaller-diameter nozzle 22C on the line L2 or L1, respectively, in FIG. 23B.

In this embodiment, a printing operation can be performed by setting the main-scanning speed at 25 inch/sec and ejecting ink through each of the larger-diameter nozzles 21 and smaller-diameter nozzles 22 (22A, 22B, and 22C) with a driving frequency of 15 kHz. This eliminates the need to increase the driving frequency for the smaller-diameter nozzles 22 even when a middle-sized dot D2 is to be formed.

Further, also in this embodiment, the number of smaller-diameter nozzles 22 is three times as large as that of larger-diameter nozzles 21. Accordingly, throughput is prevented from decreasing even if a photograph-grade image is to be printed. Furthermore, a large dot is formed by ink droplets ejected through the larger-diameter nozzle 21 and the smaller-diameter nozzle 22. Consequently, the volume of ink droplets ejected through the larger-diameter nozzle 21 can be reduced from 10 pl to 8 pl, thereby increasing ink refilling frequency. Further, the driving frequency of 15 kHz further improves printing throughput.

Eleventh Embodiment

Figure 26:
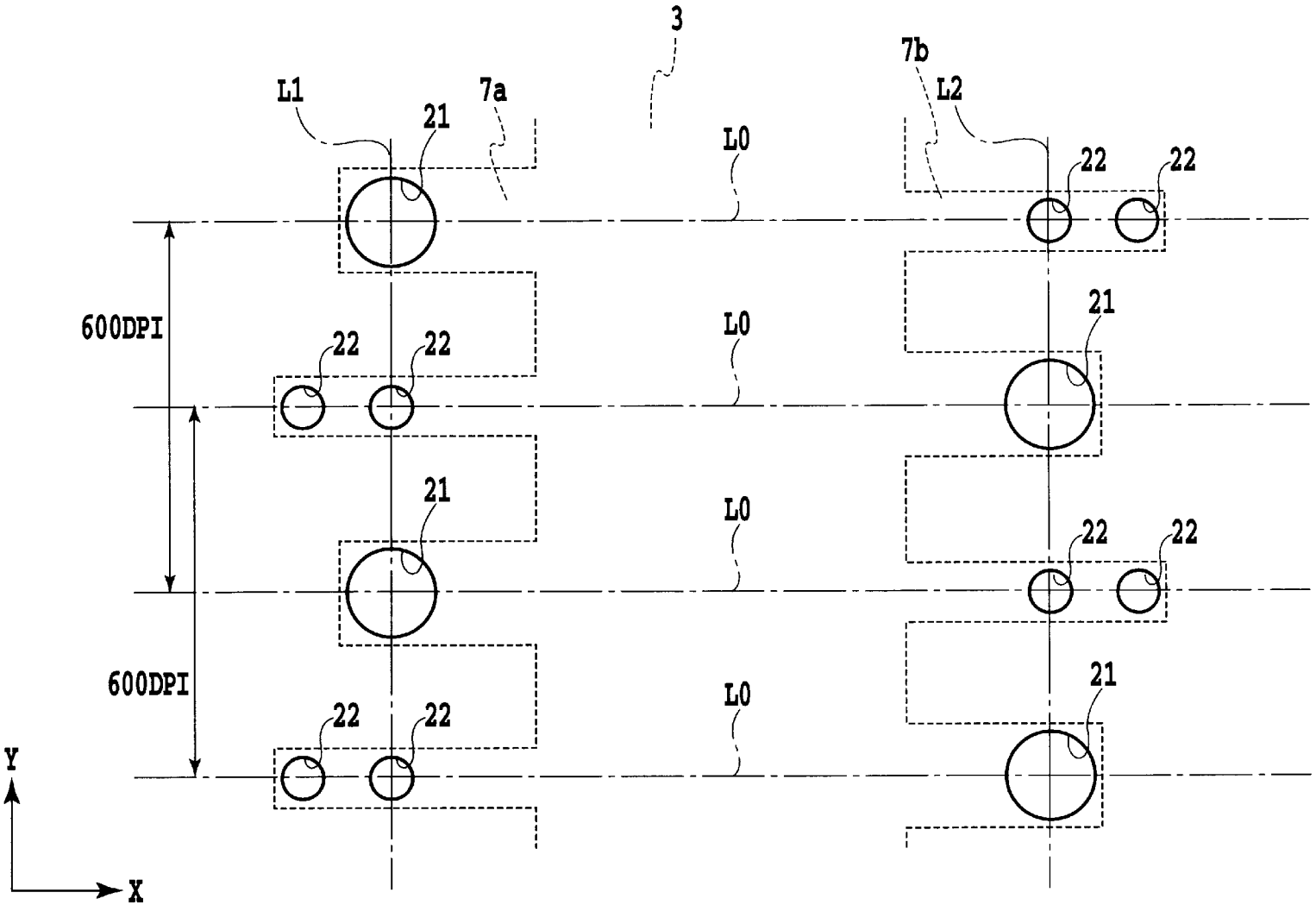
FIG. 26 is a plan view showing an essential part of a printing head according to an eleventh embodiment of the present invention.

FIG. 26 is a plan view of an essential part of a printing head according to an eleventh embodiment of the present invention.

In this embodiment, the plurality of smaller-diameter nozzles 22 constituting the group of smaller-diameter nozzles are arranged on the centerline L0, extending along the X direction (main-scanning direction) and through the center of the larger-diameter nozzle 21. Also in this embodiment, along each of the lines L1 and L2, the group of smaller-diameter nozzles composed of the plurality of smaller-diameter nozzles 22 is arranged between two larger-diameter nozzles 21. Accordingly, as in the first embodiment, not only the larger-diameter nozzles 21 but also the smaller-diameter nozzles 22 can be appropriately recovered.

In this embodiment, the distance between two larger-diameter nozzles 21 in the Y direction corresponds to a resolution of 600 DPI. The distance between two smaller-diameter nozzles 22 in the Y direction corresponds to a resolution of 600 DPI. On each of the lines L1 and L2, one larger-diameter nozzle 21 alternates with one smaller-diameter nozzle 22. Furthermore, the smaller-diameter nozzle 22 is formed at a position deviating from the smaller-diameter nozzle 22 on the line L1 in the −X direction. On the other hand, the smaller-diameter nozzle 22 is formed at a position deviating from the smaller-diameter nozzle 22 on the line L2 in the +X direction. The centers of the larger-diameter nozzle 21 and smaller-diameter nozzle 22 which are located adjacent to each other in the direction of the arrow X lie on the centerline L0. Consequently, one larger-diameter nozzle 21 on the line L1 or L2 and corresponding two smaller-diameter nozzles 22 on the line L2 or L1, respectively, lie on the same centerline L0.

Figure 27:
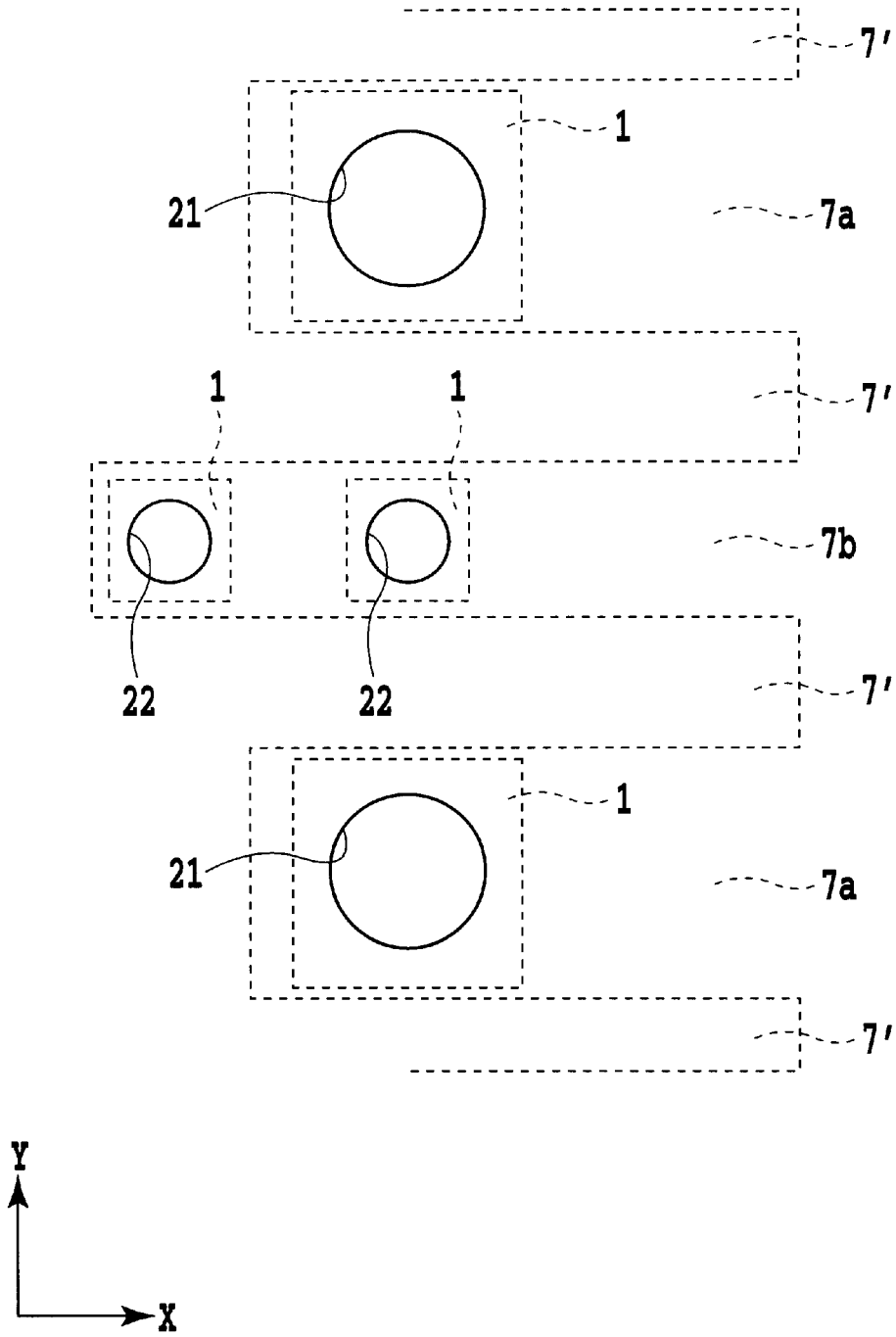
FIG. 27 is a plan view of peripheral portions of nozzles in the printing head shown in FIG. 26.

FIG. 27 is an enlarged view illustrating the structure of the ink channels in the printing head 10 in this example.

In each of the lines L1 and L2, two smaller-diameter nozzles 22 arranged adjacent to each other in the direction of the arrow X are in communication with the common ink channel 7*b*. The common ink channel 7*b* is provided with the electrothermal conversion elements 1 corresponding to the two smaller-diameter nozzles 22, respectively. Accordingly, one common ink channel 7*b* is provided with two smaller-diameter nozzles 22 and two electrothermal conversion elements 1.

Further, as shown in FIG. 26, ink channel 7*a* in communication with the larger-diameter nozzle and ink channel 7*b* in communication with the plurality of smaller-diameter nozzles composing the group of the smaller-diameter nozzles are alternately arranged along the extending direction of the ink supply port at equal intervals.

With the printing head 10 of this example, within a unit print area of 600×600 DPI, a large dot D1 is formed by an ink droplet ejected through the larger-diameter nozzle 21, and a small dot D3 is formed by an ink droplet ejected through the smaller-diameter nozzle 22, as in FIG. 16 described previously. Further, a middle-sized dot D2 is formed by ink droplets ejected through two smaller-diameter nozzles located on each of the lines L1 and L2 adjacent to each other in the direction of the arrow X, that is, by two small dots D3. The large dots D1, middle-sized dots D2, and small dots D3 are printed as in the first embodiment. This example serves to increase the printing resolution of the large dots D1 in the direction of the arrow Y (sub-scanning direction). Therefore, images can be printed with an increased definition.

Ink from the ink storage section including the ink tanks 54 and others is filled into the printing head 10 through a sucking- or pressurization-based filling operation performed by the ink-jet printing apparatus. The ink is filled into the nozzles 21 and 22 via the ink supply port 3. In this example, on each of the lines L1 and L2, two smaller-diameter nozzles 22 are arranged between two larger-diameter nozzle 21. Thus, the nozzle lines L1 and L2 have an equal viscous resistance for ink. Accordingly, in this embodiment, owing to the operation performed by the ink-jet printing apparatus to fill the printing head with ink through sucking or pressurization, as well as the operations and effects of the first embodiment described previously, the ink can be reliably filled into the nozzles 21 and 22 while preventing bubbles from remaining in the ink supply port 3 or the like. Further, instead of the ink supply form in which ink is supplied through the ink supply port 3, formed in the center of the substrate 4, as shown in FIGS. 1 and 2, described previously, ink may be supplied from two locations, i.e. the opposite ends of the substrate 4. Both supply forms produce similar effects.

Twelfth Embodiment

Figure 28:
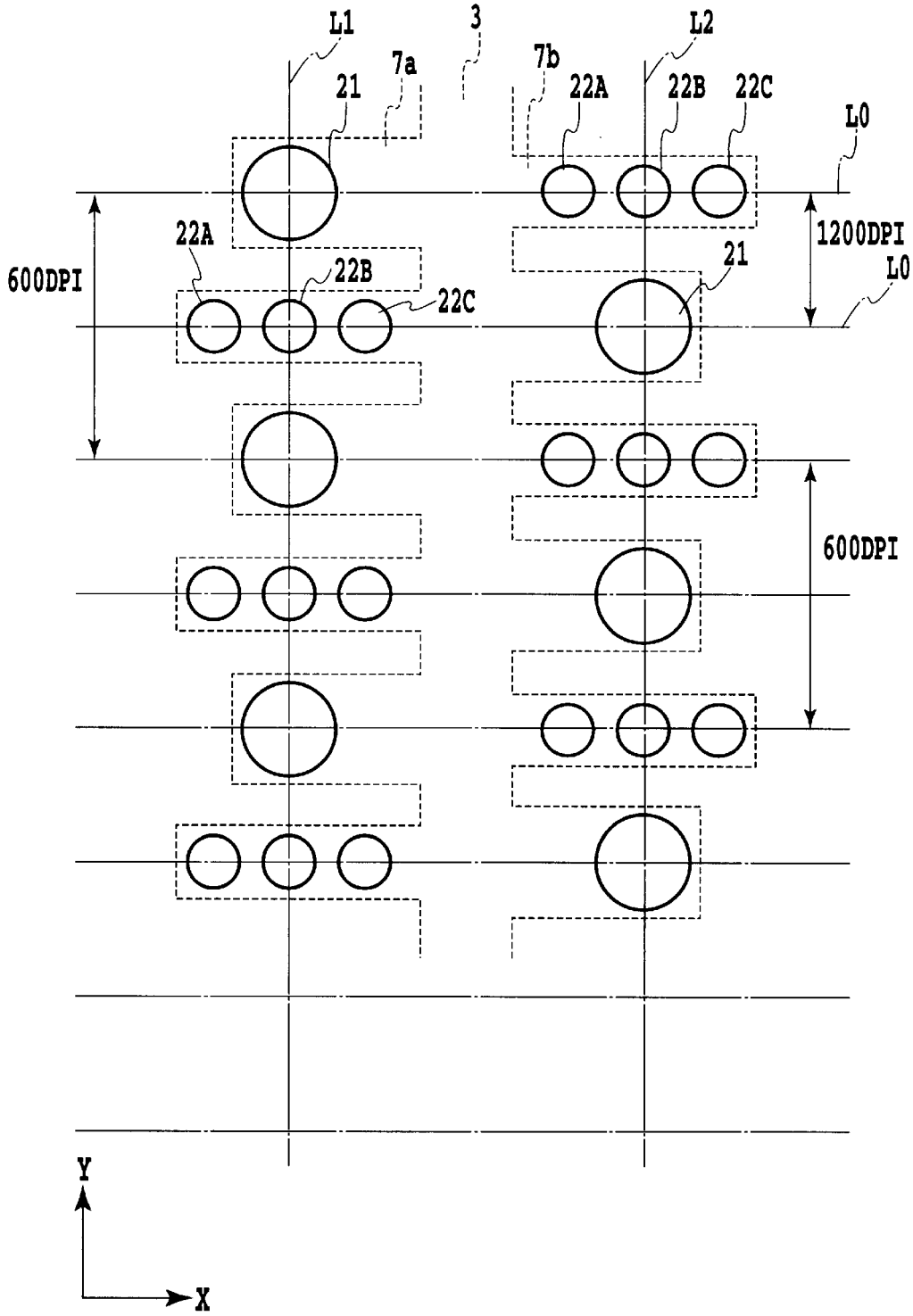
FIG. 28 is a plan view showing an essential part of a printing head according to a twelfth embodiment of the present invention.

FIG. 28 is a plan view of an essential part of a printing head according to a twelfth embodiment of the present invention.

In this embodiment, a plurality of smaller-diameter nozzles 22 are arranged on the centerline extending along the X direction (main-scanning direction) and through the center of the larger-diameter nozzle 21, as in the eleventh embodiment described previously. The plurality of smaller-diameter nozzles 22 constitutes a group of smaller-diameter nozzles between two larger-diameter nozzles 21. In this example, the group of smaller-diameter nozzles is composed of three smaller-diameter nozzles 22 (22A, 22B, and 22C). The smaller-diameter nozzle 22B is located on each of the lines L1 and L2. The smaller-diameter nozzle 22A is located so as to deviate from each of the lines L1 and L2 in the −X direction. The smaller-diameter nozzle 22C is located so as to deviate from each of the lines L1 and L2 in the +X direction.

Also in this embodiment, the plurality of ink channels 7*a* in communication with the plurality of larger-diameter nozzles 21 and the plurality of ink channels 7*b* in communication with a plurality of smaller-diameter nozzles 22 are arranged with mixing, and moreover, the plurality of larger- and smaller-diameter 21 and 22 are formed on lines L1 and L2 so that a group of smaller-diameter nozzles composed of the plurality of smaller-diameter nozzles 22 is arranged between the larger-diameter nozzles 21. Accordingly, as in the first embodiment, not only the larger-diameter nozzles 21 but also the smaller-diameter nozzles 22 can be appropriately recovered.

Figure 29:
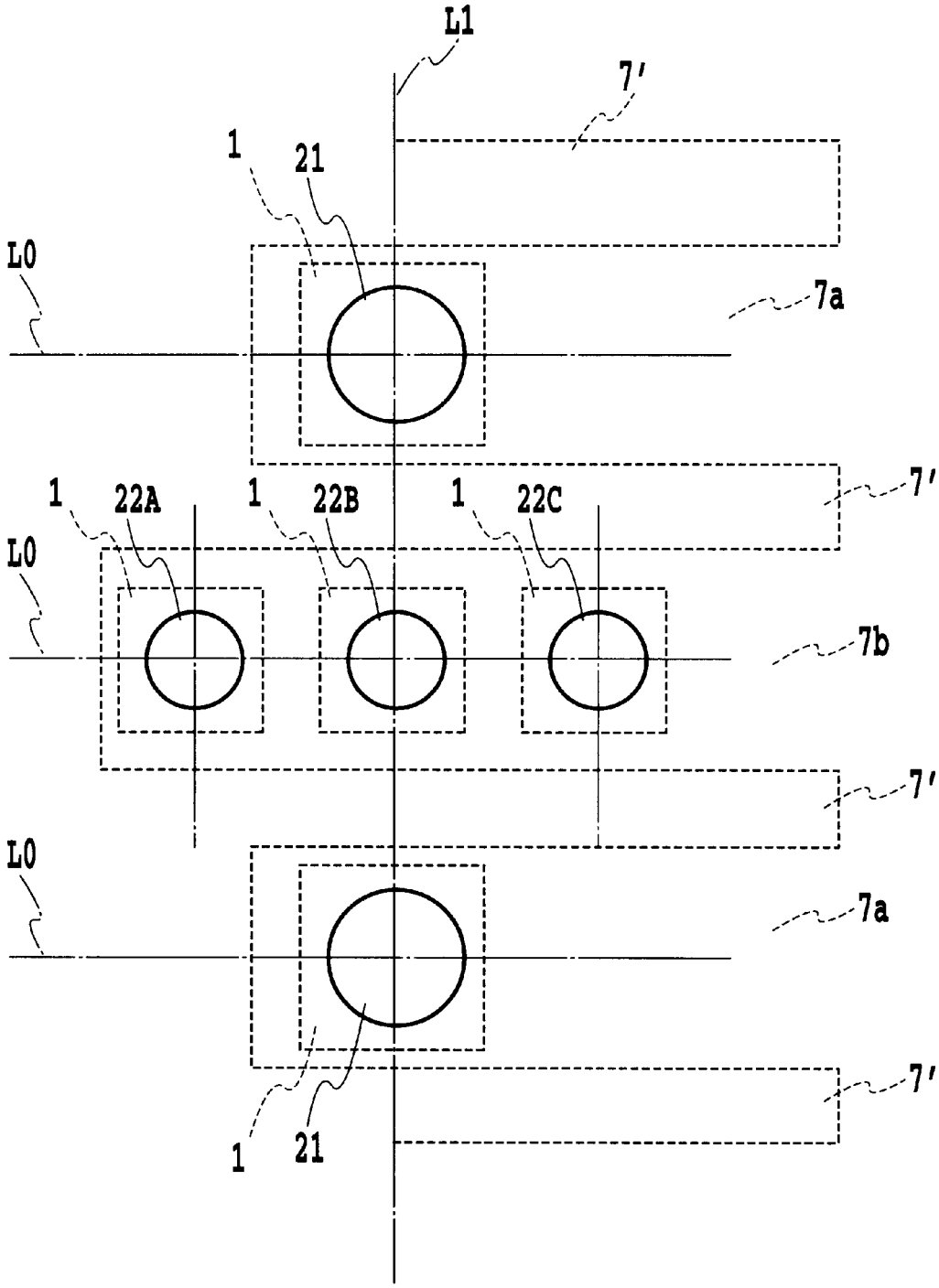
FIG. 29 is a plan view of peripheral portions of nozzles in the printing head shown in FIG. 28.

In this embodiment, the distance between two larger-diameter nozzles 21 corresponds to a resolution of 600 DPI. The distance between two groups of smaller-diameter nozzles 22 (22A, 22B, 22C) also corresponds to a resolution of 600 DPI. The volume of ink ejected through the larger-diameter nozzle 21 is 6 pl. The volume of ink ejected through the smaller-diameter nozzle 22 is 2 pl. Further, on each of the lines L1 and L2, the distance between the larger-diameter nozzle 21 and the group of smaller-diameter nozzles 22 corresponds to a resolution of 1200 DPI. The center of the larger-diameter nozzle 21 on the line L1 or L2 coincides with the center of the smaller-diameter nozzle 22 (22A, 22B, or 22C) on the line L2 or L1, respectively (centerline L0). The three smaller-diameter nozzles 22A, 22B, and 22C are formed in one common ink channel 7*b* as shown in FIG. 29. The common ink channel 7*b* is provided with the electrothermal conversion elements 1 corresponding to the three smaller-diameter nozzles 22, respectively. Accordingly, one common ink channel 7*b* is provided with three smaller-diameter nozzles 22 and three electrothermal conversion elements 1.

Figure 30:
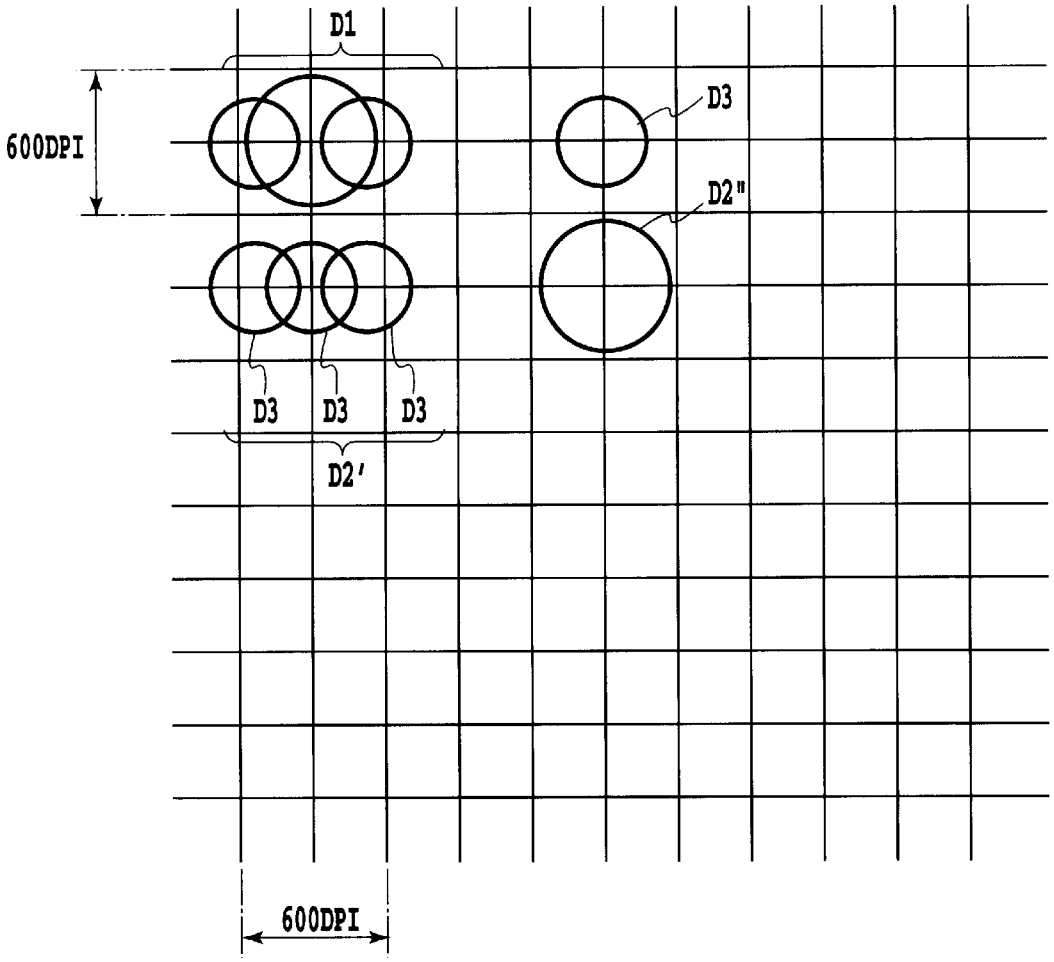
FIG. 30 is a diagram illustrating dots that can be formed using the printing head shown in FIG. 28.

FIG. 30 is a diagram illustrating the arrangement of dots formed on a printing medium according to this embodiment.

A large dot D1 is formed within a unit print area of 600×600 DPI by an ink droplet ejected through the larger-diameter nozzle 21 and ink droplets ejected through the two smaller-diameter nozzles 22A and 22C. The former larger-diameter nozzle 21 is located on the line L1 or L2, whereas the latter two smaller-diameter nozzles 22A and 22C are located on the other line L2 or L1, respectively, and on the same raster as that for the former larger-diameter nozzle 21. A small dot D3 is formed by an ink droplet ejected through the smaller-diameter nozzle 22B. Further, two forms of middle-sized dots are formed. One of them, a middle-sized dot D2' is formed by three ink droplets ejected through the three smaller-diameter nozzles 22A, 22B, and 22C. The other form, a middle-sized dot D2 " is formed by one ink droplet ejected through the larger-diameter nozzle 21.

Ink from the ink storage section including the ink tanks 54 and others is filled into the printing head 10 through a sucking-or pressurization-based filling operation performed by the ink-jet printing apparatus. The ink is filled into the nozzles 21 and 22 via the ink supply port 3. In this example, on each of the lines L1 and L2, three smaller-diameter nozzles 22 are arranged between the larger-diameter nozzles 21. Thus, the nozzle lines L1 and L2 have an equal viscous resistance for ink. Accordingly, in this embodiment, owing to the operation performed by the ink-jet printing apparatus to fill the printing head with ink through sucking or pressurization, as well as the operations and effects of the first embodiment described previously, the ink can be reliably filled into the nozzles 21 and 22 while preventing bubbles from remaining in the ink supply port 3 or the like. Further, instead of the ink supply form in which ink is supplied through the ink supply port 3, formed in the center of the substrate 4, as shown in FIGS. 1 and 2 described previously, ink may be supplied from two locations, i.e. the opposite ends of the substrate 4. Both supply forms produce similar effects.

Thus, in this embodiment, the number of smaller-diameter nozzles 22 is three times as large as that of larger-diameter nozzles 21. Further, the center of the larger-diameter nozzle 21 on the line L1 or L2 coincides with the center of each of the three smaller-diameter nozzles 22A, 22B, and 22C on the line L2 or L1, respectively (centerline L0). This serves to increase the resolution of the larger-diameter nozzles 21 in the X direction (main-scanning direction), enabling images to be printed with an increased definition. Further, the amount of ink ejected through the one larger-diameter nozzles 21 equals the sum of the amounts of ink ejected through the three smaller-diameter nozzles 22A, 22B, and 22C. Thus, a driving frequency used to form a large dot may be the same as that used to form a middle-sized dot D2" using only an ink droplet ejected through the larger-diameter nozzle 21. This eliminates the need to increase the driving frequency for the smaller-diameter nozzles 22 even when a large dot is to be formed. Furthermore, a driving frequency used to form a middle-sized dot D2' using three ink droplets ejected through the three smaller-diameter nozzles 22A, 22B, and 22C may be the same as that used to form a middle-sized dot D2" using only an ink droplet ejected through the larger-diameter nozzle 21. This enables images to be printed at high speed without increasing the driving frequency for the smaller-diameter nozzles 22.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink-jet printing head comprising:

a plurality of nozzles through which ink is ejected;

a plurality of ejection energy generating members provided in correspondence with said plurality of nozzles to generate ejection energy used to eject ink through said plurality of nozzles;

a plurality of ink channels which are in communication with said plurality of nozzles and which are provided with said plurality of ejection energy generating members; and an ink supply port through which ink is supplied to said plurality of ink channels, wherein said plurality of nozzles include larger-diameter nozzles and smaller-diameter nozzles, the number of smaller-diameter nozzles being larger than that of larger-diameter nozzles, said plurality of ink channels include first ink channels in communication with said larger-diameter nozzles and second ink channels in communication with said smaller-diameter nozzles, and said first ink channels and said second ink channels are mixed and arranged along said ink supply port so that a group of smaller-diameter nozzles composed of a plurality of said smaller-diameter nozzles is arranged between said larger-diameter nozzles.

2. An ink-jet printing head as claimed in claim 1, wherein said plurality of ink channels are arranged on a plurality of ink channel lines substantially parallel to each other, and said larger-diameter nozzles are staggered on adjacent ones of said ink channel lines.

3. An ink-jet printing head as claimed in claim 2, wherein said plurality of larger-diameter nozzles are arranged along said ink channel lines at equal intervals, and said plurality of smaller-diameter nozzles are arranged along said ink channel lines at equal intervals.

4. An ink-jet printing head as claimed in claim 1, wherein a distance between a center of one of said first ink channels and a center of one of said second ink channels adjacent to said one first ink channel in an arrangement direction in which said ink channels are arranged is longer than a distance between centers of a pair of said second ink channels adjacent to each other in the arrangement direction.

5. An ink-jet printing head as claimed in claim 1, wherein said group of smaller-diameter nozzles is composed of said plurality of said smaller-diameter nozzles arranged along a direction in which said ink channels are arranged.

6. An ink-jet printing head as claimed in claim 1, wherein said group of smaller-diameter nozzles is composed of said plurality of said smaller-diameter nozzles arranged along a direction in which ink is supplied through said ink channels.

7. An ink-jet printing head as claimed in claim 1, wherein said ink-jet printing head ejects ink while being moved in a scanning direction, and said larger-diameter nozzles and said smaller-diameter nozzles are arranged so as to deviate from each other in the scanning direction depending on a difference in ink droplet ejection speed between said larger-diameter nozzles and said smaller-diameter nozzles.

8. An ink-jet printing head as claimed in claim 1, wherein said larger-diameter nozzles and said smaller-diameter nozzles are arranged so as to deviate from each other in a direction in which ink is supplied through said ink channels.

9. An ink-jet printing head as claimed in claim 1, wherein through said plurality of smaller-diameter nozzles constituting said group of smaller-diameter nozzles, ink is ejected in directions that approach each other.

10. An ink-jet printing head as claimed in claim 1, wherein all said smaller-diameter nozzles of said group are in communication with a single one of said ink channels.

11. An ink-jet printing head as claimed in claim 10, wherein said one ink channel with which said group of smaller-diameter nozzles are in communication is composed of a common portion that is in communication with said ink supply port and branch portions connected to said common portion and branching to said respective smaller-diameter nozzles.

12. An ink-jet printing head as claimed in claim 10, wherein first ink channels that are in communication with said larger-diameter nozzles and said one second ink channel with which all of said plurality of smaller-diameter nozzles constituting said group of smaller-diameter nozzles are in communication are located alternately along the direction in which said plurality of ink channels are arranged and at fixed intervals.

13. An ink-jet printing head as claimed in claim 1, wherein said ejection energy generating members are electrothermal converters that apply thermal energy to ink in said ink channels.

14. An ink-jet printing method for printing on a printing medium using an ink-jet printing head as claimed in claim 1, wherein the printing medium is printed on using ink droplets ejected through said larger-diameter nozzles and through said smaller-diameter nozzles.

15. An ink-jet printing method as claimed in claim 14, wherein a large dot is formed using an ink droplet ejected through one of said larger-diameter nozzles, a middle-sized dot is formed using ink droplets ejected through the respective smaller-diameter nozzles constituting said group of smaller-diameter nozzles, and a small dot is formed using an ink droplet ejected through one of said smaller-diameter nozzles.

16. An ink-jet printing method as claimed in claim 14, wherein printing is carried out using a middle-sized dot formed using an ink droplet ejected through one of said larger-diameter nozzles and a middle-sized dot formed using a plurality of ink droplets ejected through said plurality of said smaller-diameter nozzles constituting said group of smaller-diameter nozzles.

17. An ink-jet printing method as claimed in claim 14, wherein said smaller-diameter nozzles constituting said group of smaller-diameter nozzles selectively eject ink according to columns defined on the printing medium.

18. An ink-jet printing method as claimed in claim 14, wherein printing is carried out by using the same driving frequency to drive said ejection energy generating members corresponding to said larger-diameter nozzles and the ejection energy generating members corresponding to the smaller-diameter nozzles constituting said group of smaller-diameter nozzles.

19. An ink-jet printing apparatus for printing on a printing medium using an ink-jet printing head as claimed in claim 1, comprising:

movement means for moving said ink-jet printing head and said printing medium relatively to each other, wherein ink droplets ejected through said larger-diameter nozzles and through said smaller-diameter nozzles are allowed to impact the printing medium.

20. An ink-jet printing apparatus as claimed in claim 19, further comprising:

recovery means for discharging ink that does not contribute to image printing, through said plurality of larger-diameter nozzles and said plurality of smaller-diameter nozzles in said ink-jet printing head.

* * * * *